US011401722B1

(12) United States Patent
Jalakian

(10) Patent No.: US 11,401,722 B1
(45) Date of Patent: Aug. 2, 2022

(54) METHOD AND SYSTEM FOR PROVIDING AN IMPROVED WALL STRUCTURE FOR SECURITY CAGES

(71) Applicant: BLUE DOT SAFES, INC., Pomona, CA (US)

(72) Inventor: Berge Jalakian, Pomona, CA (US)

(73) Assignee: Cages 4 LLC, Kennesaw, GA (US)

( * ) Notice: Subject to any disclaimer, the term of this patent is extended or adjusted under 35 U.S.C. 154(b) by 0 days.

(21) Appl. No.: 16/518,893

(22) Filed: Jul. 22, 2019

(51) Int. Cl.
*E04H 1/12* (2006.01)

(52) U.S. Cl.
CPC ..... *E04H 1/125* (2013.01)

(58) Field of Classification Search
CPC ..... E04H 1/125; F16B 5/0012; F16B 5/002; F16B 12/02
USPC ..... 52/106, 272, 588.1
See application file for complete search history.

(56) References Cited

U.S. PATENT DOCUMENTS 424,936 A * 4/1890 Schoenfeld ..... E04H 3/08 52/106
1,818,522 A * 8/1931 Youngblood ..... E04H 1/12 52/106
2,388,297 A * 11/1945 Slaughter ..... B29C 66/43 446/87
3,362,739 A * 1/1968 Staeger ..... F16B 12/02 52/285.1
3,380,769 A * 4/1968 Piget ..... F16B 12/02 403/326
4,267,679 A * 5/1981 Thompson ..... E04B 1/80 52/545
4,383,397 A * 5/1983 Ward ..... F16B 12/02 403/231
4,700,809 A * 10/1987 Lazar ..... B66B 11/0206 187/401
4,843,788 A * 7/1989 Gavin ..... E04H 3/08 52/750
5,228,257 A * 7/1993 Bowersox ..... E04C 2/08 52/762
5,842,545 A * 12/1998 Blaiotta ..... B66B 11/0253 187/401
6,834,468 B1 * 12/2004 Kroie ..... B32B 15/12 52/794.1
6,889,475 B2 * 5/2005 De Zen ..... E04H 1/1205 52/91.1

(Continued)

*Primary Examiner* — Brian E Glessner
*Assistant Examiner* — Adam G Barlow
(74) *Attorney, Agent, or Firm* — Smith Tempel; Steven P. Wigmore

(57) ABSTRACT

A method and system for providing improved wall structures within a security cage includes one or more unique couplings that are provided at the intersection where two wall panels may join together. Each wall panel of the security cage may have two edges where each edge is designed to mate with another edge of a respective adjacent wall panel. Each edge may have a geometry that is one of two types: an open facing geometry and a closed facing geometry. Each open facing geometry edge is designed to mate with a closed facing geometry edge. This means that usually a first wall panel having an open facing geometry edge will mate with a second wall panel having a closed facing geometry edge and vice-versa. Each open facing geometry wall edge may have a first unique geometry and each closed facing geometry wall edge may have a second unique geometry.

14 Claims, 19 Drawing Sheets

(56) References Cited

U.S. PATENT DOCUMENTS

| | | | | |
|---|---|---|---|---|
| 7,117,644 | B2 * | 10/2006 | Dehart | E04H 9/10 52/79.5 |
| 7,318,300 | B1 * | 1/2008 | Seavy | E04H 3/08 52/106 |
| 7,882,667 | B2 * | 2/2011 | Smith | E04B 1/08 52/592.1 |
| 9,127,917 | B2 * | 9/2015 | Phillips | F41H 5/24 |
| 9,567,764 | B2 * | 2/2017 | Phillips | F41H 5/24 |
| 10,557,262 | B2 * | 2/2020 | Moran | E04B 1/61 |
| 2003/0066249 | A1 * | 4/2003 | Walsh | E04H 6/02 52/106 |

* cited by examiner

METHOD AND SYSTEM FOR PROVIDING AN IMPROVED WALL STRUCTURE FOR SECURITY CAGES

BACKGROUND

Conventional security cages are often very cumbersome/difficult to assemble because of the numerous parts and fasteners which are needed to form a respective structure. Conventional security cages frequently require numerous fasteners since many of the major structures, like walls and/or mesh-like fencing, are small relative to the size of the entire structure. Each of the smaller parts needs to be connected together with fasteners (i.e. screws, nuts & bolts, etc.) to form the entire structure.

Because there are so many fasteners needed for the smaller parts to construct conventional security cages, conventional security cages often have too much play and/or slack in their connections or joints which require the fasteners to couple structures together. Such "play" or slack in the connections, such as between adjoining panels or walls forming the structure, is undesirable because the security of such conventional cages may be compromised. Security may be compromised since these loose joints or connections maybe vibrated or shaken in order to create holes and/or fractures within the walls or connections of the structure.

Accordingly, what is needed in the art is a security cage which has less fasteners and increased structural integrity. Another need in the art is a security cage with increased structural integrity but is easy to assemble and build within a structure, such as constructing a security cage within an indoor space like a building (i.e. warehouse, large office space, etc.). Specifically, what is needed in the art is a security cage having improved wall structures where connections between walls are easily to assemble while also providing for increased structural integrity and security.

SUMMARY OF THE DISCLOSURE

A method and system for providing improved wall structures within a security cage includes one or more unique couplings that are provided at the intersection where two walls may join together. Each wall of the security cage may have two edges where each edge is designed to mate with another edge of a respective adjacent wall. Each edge may have a geometry that is one of two types: an open facing geometry and a closed facing geometry. Each open facing geometry edge is designed to mate with a closed facing geometry edge.

This means that usually a first wall having an open facing geometry edge will mate with a second wall having a closed facing geometry edge and vice-versa. Each open facing geometry wall edge may have a first unique geometry and each closed facing geometry wall edge may have a second unique geometry.

This summary is provided to introduce a selection of concepts that are further described below in the detailed description. This summary is not intended to identify key or essential features of the claimed subject matter, nor is it intended to be used as an aid in limiting the scope of the claimed subject matter

BRIEF DESCRIPTION OF THE DRAWINGS

The word "exemplary" is used herein to mean "serving as an example, instance, or illustration." Any aspect described herein as "exemplary" is not necessarily to be construed as exclusive, preferred or advantageous over other aspects.

DETAILED DESCRIPTION OF EXEMPLARY EMBODIMENTS

Figure 1:
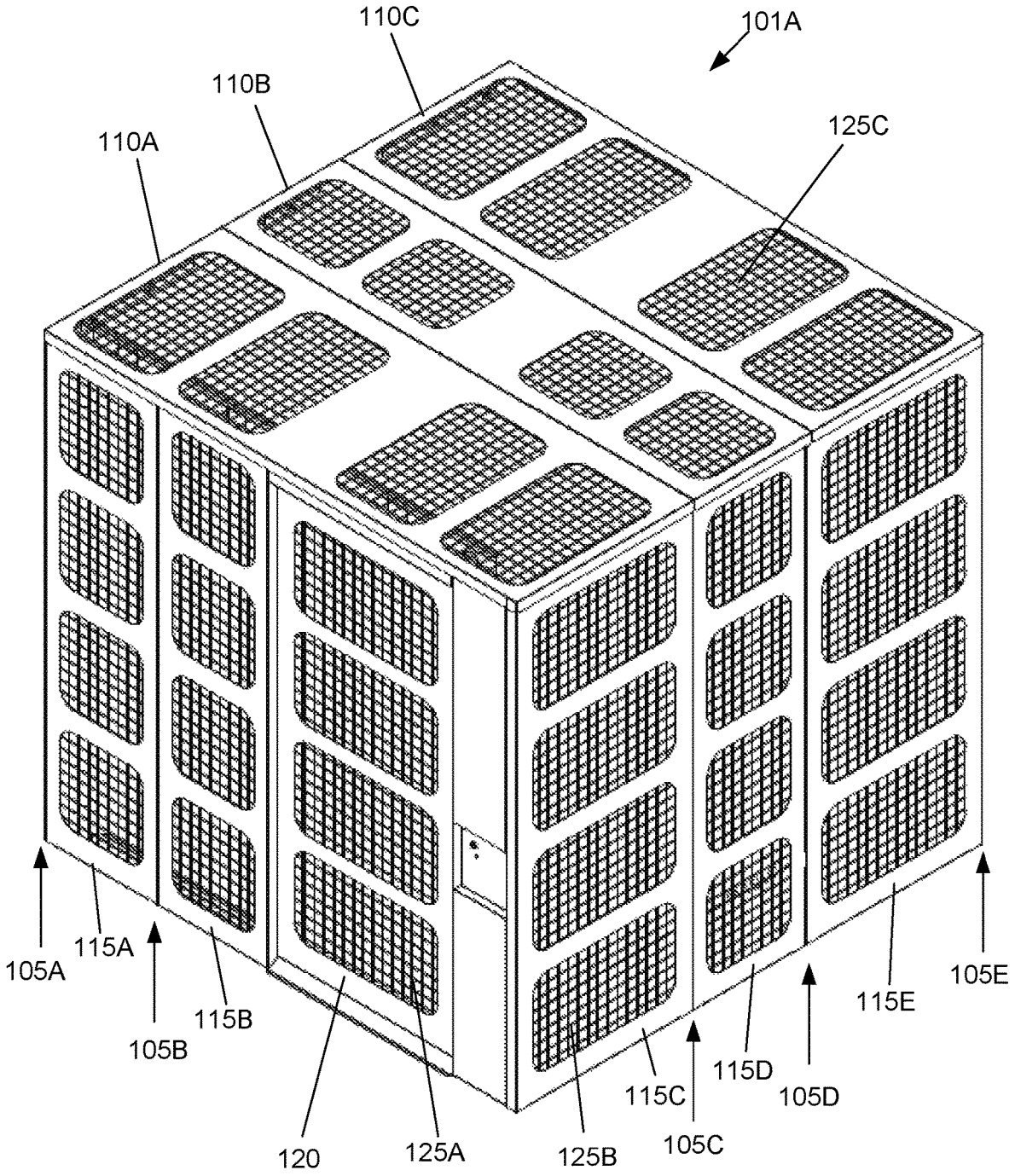
FIG. 1 illustrates a system for providing improved wall structures for a completed security cage according to an exemplary embodiment.

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

Referring now to FIG. 1, this figure illustrates a system 101A for providing improved wall structures to form a completed security cage according to an exemplary embodiment. The system 101A may comprise a plurality of ceiling panels 110, wall panels 115, and a door 120. The system 101 further comprises unique connections/couplings 105 that join one wall panel 115 with another wall panel 115. These unique connections/couplings 105 between wall panels 115 will be described in further detail below.

Each panel 110, 115 or door 120 may comprise a mesh or screen section 125. Each screen section 125 may comprise a plurality of criss-crossed metal rods which overlap/intersect each other at about ninety degree angles. However, other patterns for each screen section 125 are possible and are included within the scope of this disclosure. Further, according to other exemplary embodiments (not shown), the screen sections 125 may be eliminated such that each panel 110, 115 or door 120 is substantially solid which would prevent any visibility into the volume enclosed by the system/cage 101 by a respective solid panel 110, 115 and/or door 120.

As also illustrated, each ceiling panel 110 may have a unique size and/or geometry relative to another ceiling panel 110. For example, a first ceiling panel 110A may have a width which is larger than a second ceiling panel 1108. Each ceiling panel 110 may also have a substantially similar size and or geometry relative to another ceiling panel 110. For example, the first ceiling panel 110A may have the same size and/or shape as the third ceiling panel 110C. The sizes/geometries of the ceiling panels 110 may be varied/mixed-and-matched OR kept uniform [in size and/or shape] to form security cages 101 with unique dimensions, as needed for a particular application/security need/security space.

It is noted that the ceiling panels 110 of the exemplary embodiment illustrated in FIG. 1 do not have the unique connection/couplings 105 that exist between respective wall panels 115 as shown in FIG. 1. However, it is possible to provide the ceiling panels with the unique connection/couplings 105 as will become apparent to one of ordinary skill in the art after reading the details about these connections/couplings 105 below.

Similar to the ceiling panels 110, as also illustrated in FIG. 1, each wall panel 115 may have a unique size and/or geometry relative to another wall panel 115. For example, a first wall panel 115A may have a width which is larger than a second wall panel 115B. Each wall panel 115 may also have a substantially similar size and or geometry relative to another wall panel 115. For example, the second wall panel 1158 may have the same size and/or shape as a fourth wall panel 115D. The sizes/geometries of the wall panels 115 may be varied/mixed-and-matched OR kept uniform [in size and/or shape] to form security cages 101 with unique dimensions, as needed for a particular application/security need/security space.

Figure 2A:
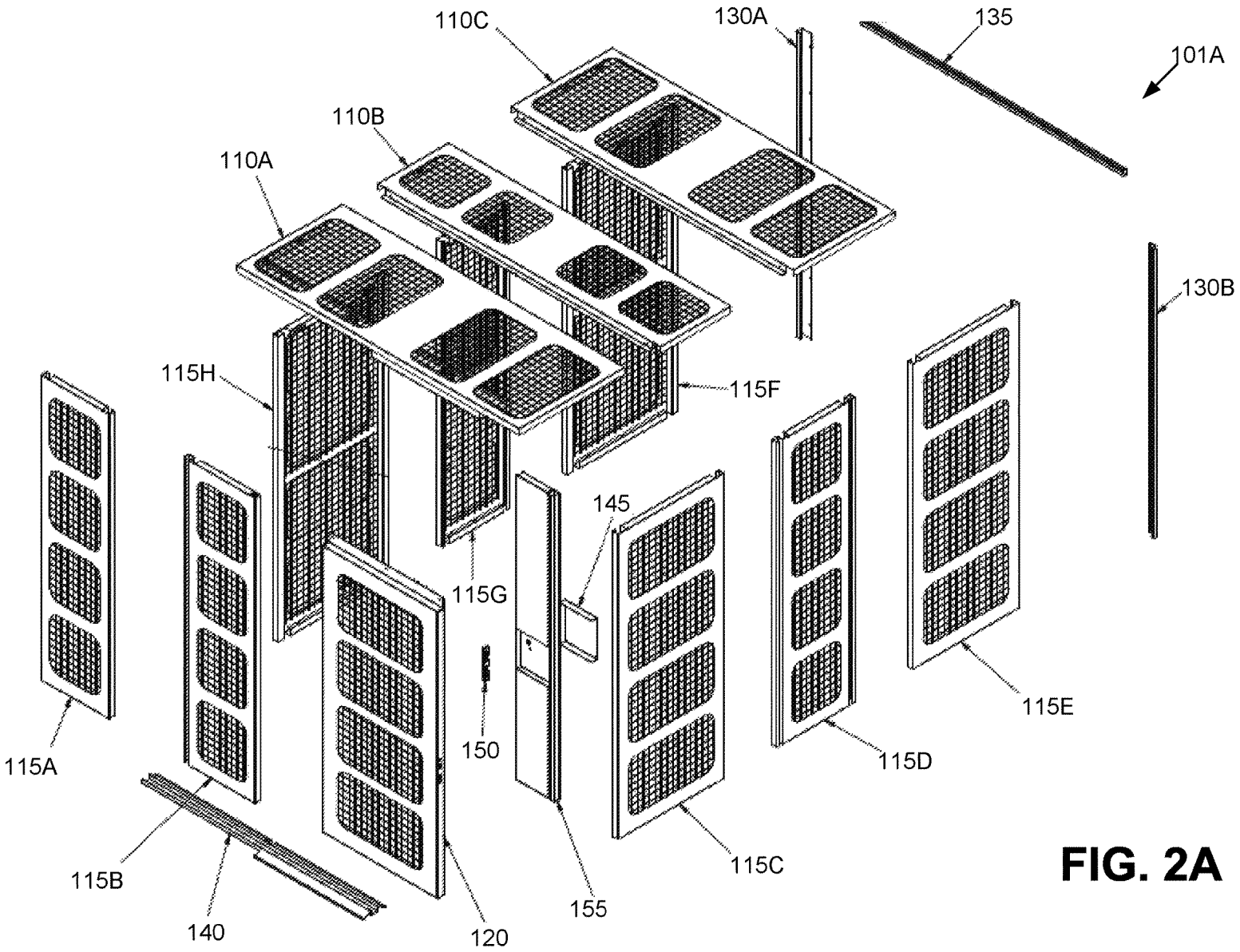
FIG. 2A illustrates an expanded, isometric view of several of the improved wall structures in an unassembled state for the security cage illustrated in FIG. 1 according to an exemplary embodiment.

FIG. 2A illustrates an expanded, isometric view of several of the improved wall structures 115 in an unassembled state for the security cage/system 101 illustrated in FIG. 1 according to an exemplary embodiment. Additional wall panels 115F, 115G, 115H are now visible in this FIG. 2A compared to the view of FIG. 1. Further, side wall mounting devices 130A, 130B and a ceiling mounting device 135 are now visible in this view when the security cage 101 is attached to a wall 300 (not shown in FIG. 2A, but see FIG. 3).

The side wall mounting devices 130A, 130B may comprise portions of the unique connections/couplings 105 mentioned above in connection with FIG. 1. A respective side wall mounting device 130A, 130B may mate with a respective wall panel 115E, 115F as will be described in further detail below.

The ceiling mounting device 135, like the ceiling panels 110, may not form or comprise the unique coupling 105 mentioned above. However, in other exemplary embodiments (not shown), it is well within the scope of this disclosure, to provide the ceiling mounting device 135 along with a respective ceiling panel 110 one of the unique couplings 105, as will become apparent to one of ordinary skill in the art after reading the details about the unique couplings 105 described below.

According to alternative exemplary embodiments, it is also possible to form the system/cage 101A, without using a wall 300 such as illustrated by the system/cage 101B in FIG. 16 described in further detail below. Further, according to alternative exemplary embodiments (not shown), more than one wall, such as two or three existing walls 300, could be used to help form a system/cage 101 without departing from the scope of this disclosure. Any number and combination of existing/ordinary walls 300 may be used with the wall panels 115 having unique couplings 105 as will become apparent to one of ordinary skill in the art.

Also illustrated in FIG. 2A are a floor mounting device 140 for the door 120, as well as a keystone plate 145, a keystone panel 155, a door latch 150, and a door side panel 160. The latch 150 and keystone plate 145 fit into the keystone panel 155 which is used to lock the door 120 when it is slides into a lock position shown in further detail in FIG. 15.

Figure 2B:
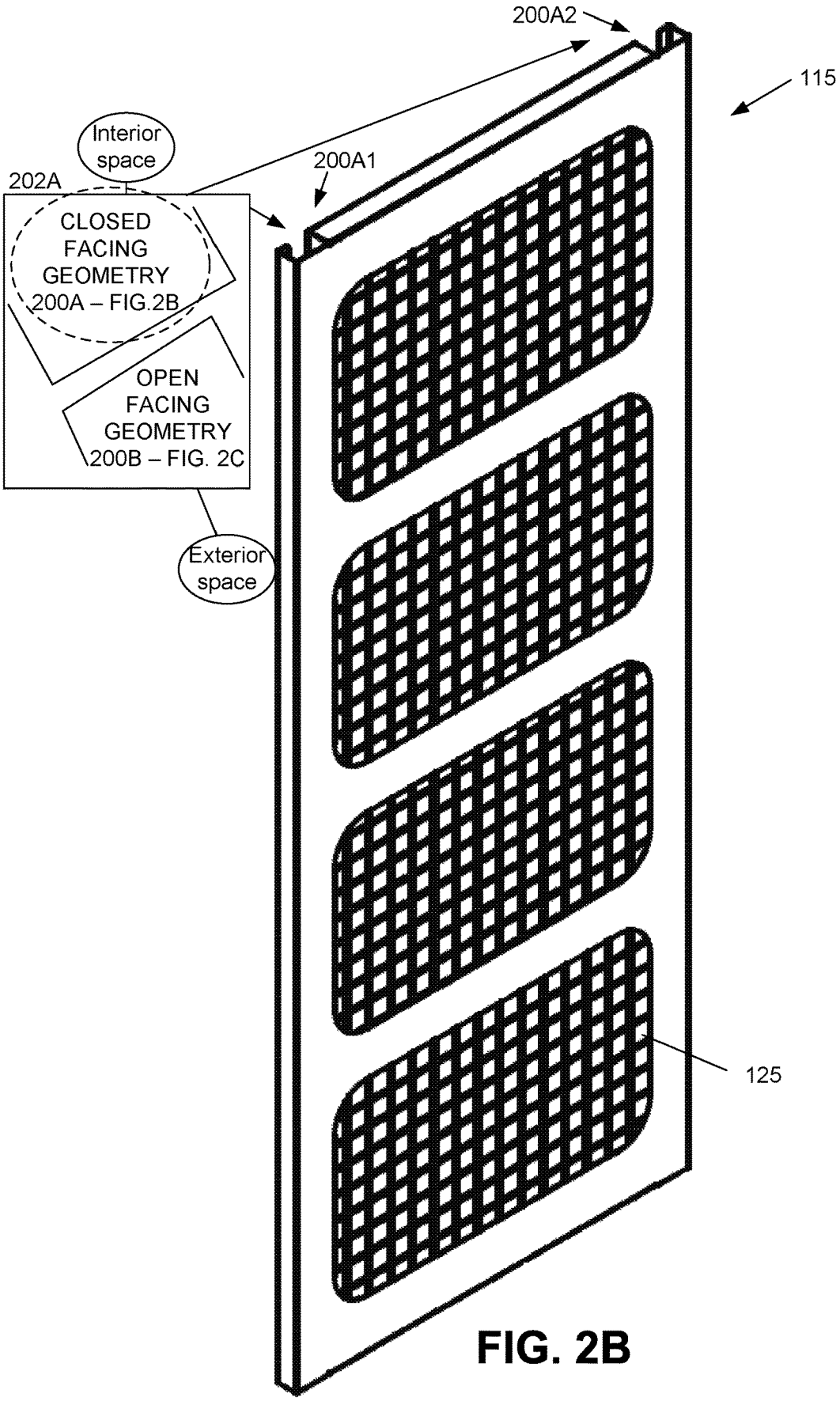
FIG. 2B illustrates a close-up, isometric view of a first improved wall of the system according to an exemplary embodiment.

FIG. 2B illustrates a close-up, isometric view of a first improved wall panel 115 of the system 101 according to an exemplary embodiment. This first wall panel 115 may be similar to the four wall panels 115A, 115C, 115E, and 115G of FIG. 2A. Based on the geometrical definition presented in box 202A, this first wall panel 115 is characterized as having two edges 200A1, 200A2, with a "closed facing geometry" relative to the interior space ultimately defined/enveloped by the system/cage 101. The edges 200A1, 200A2 have a geometry which are "closed facing" relative to the interior space being protected by the first wall panel 115.

While the first wall panel 115 of FIG. 2B is illustrated as having two edges 200A1, 200A2, having similar two "closed facing geometries," it is possible and it is within the scope of this disclosure to construct a wall panel 115 (not illustrated) which has one edge 200A with a closed facing geometry and one edge 200B with an open facing geometry. Each closed facing geometry edge 200A will mate with an open facing geometry edge 200B to form the couplings 105 of FIG. 1. The mating/couplings 105 of the edges 200A, 200B will be described below in connection with at least FIGS. 5A-8E.

Figure 2C:
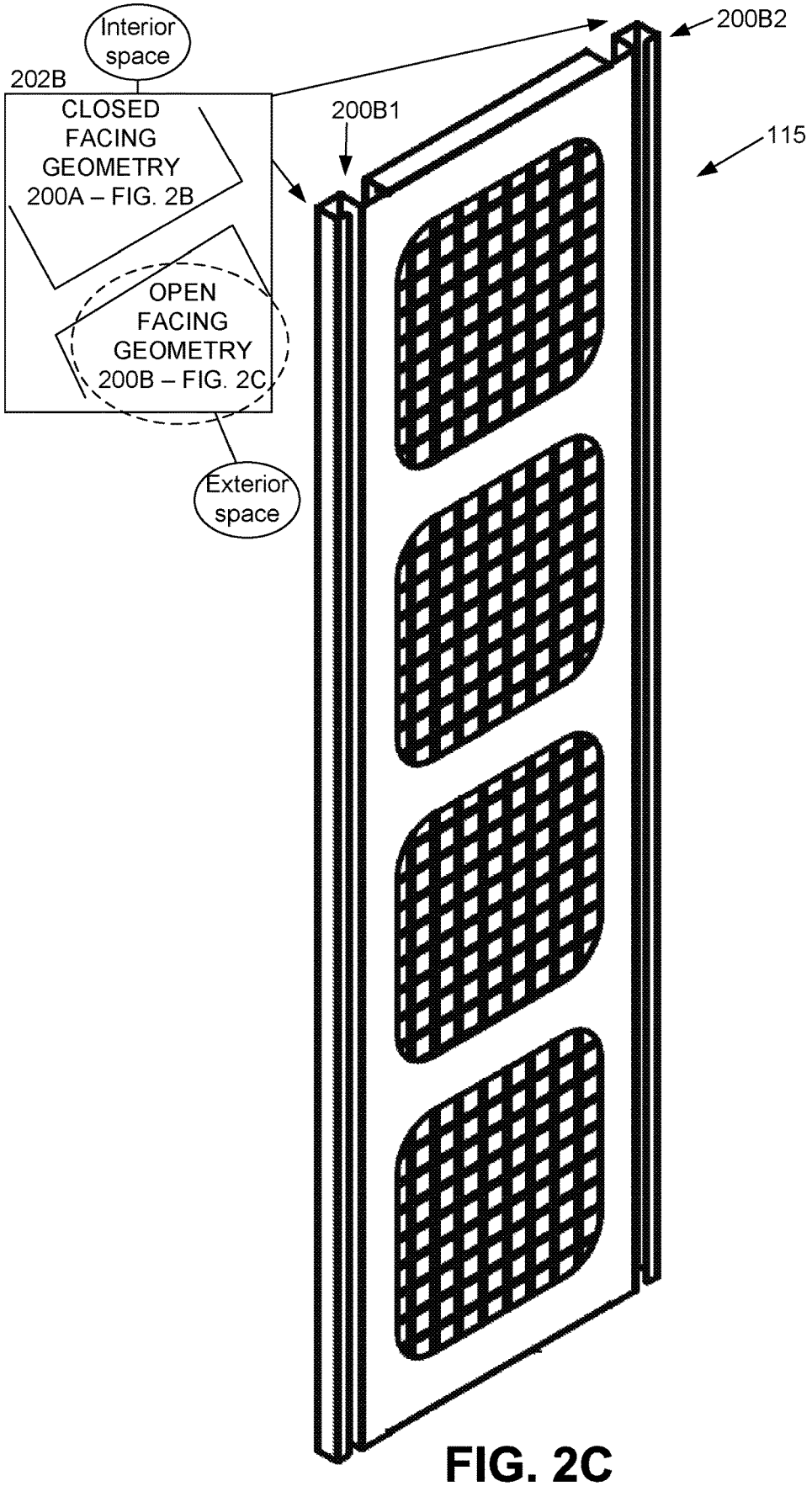
FIG. 2C illustrates a close-up, isometric view of a second improved wall of the system according to an exemplary embodiment.

FIG. 2C illustrates a close-up, isometric view of a second improved wall 115 of the system 101 according to an exemplary embodiment. This second wall panel 115 may be similar to the three wall panels 115D, 115F, 115H of FIG. 2A. Based on the geometrical definition presented in box 202B, this second wall panel 115 is characterized as having two edges 200B1, 200B2, with a "open facing geometry" relative to the interior space ultimately defined/enveloped by the system/cage 101. The edges 200B1, 200B2 have a geometry which are "open facing" relative to the interior space being protected by this second wall panel 115.

While the second wall panel 115 of FIG. 2C is illustrated as having two edges 200B1, 200B2, having similar two "open facing geometries," it is possible and it is within the scope of this disclosure to construct a wall panel 115 (not illustrated) which has one edge 200A with a closed facing geometry (See FIG. 2B) and one edge 200B with an open facing geometry as shown in FIG. 2C. Each open facing geometry edge 200B will mate with a closed facing geometry edge 200A to form the couplings 105 of FIG. 1. The mating/couplings 105 of the edges 200A, 200B will be described below in connection with at least FIGS. 5A-8E.

Referring back to FIG. 2A, it is noted that wall panels 115 on opposite sides of the cage may have different edge geometries 200. For example, wall panel 115E may comprise the closed facing geometry edges 200A, while wall panel 115F on the opposite side may comprise the open facing geometry edges 200B. Similarly, wall panel 115D may comprise open facing geometry edges 200B, while wall panel 115G on the opposite side may comprise closed facing geometry edges 200A. As noted previously, geometries of edges 200 for each wall panel 115 may be mixed-and-matched so long as respective edges 200 may mate with one another (an open facing geometry edge 200B mating with a closed facing geometry edge 200A). This means that each panel 115 may comprise a pair of identical geometry edges 200 or a pair of opposite geometry edges, like edges 200A, 200B. It is further noted that panel 115B nearest to the door panel 120 may comprise only one of the unique edges 200, while another (closest to the door panel 120) does not have a uniquely shaped edge 200, as illustrated in FIGS. 2B and 2C.

Figure 3:
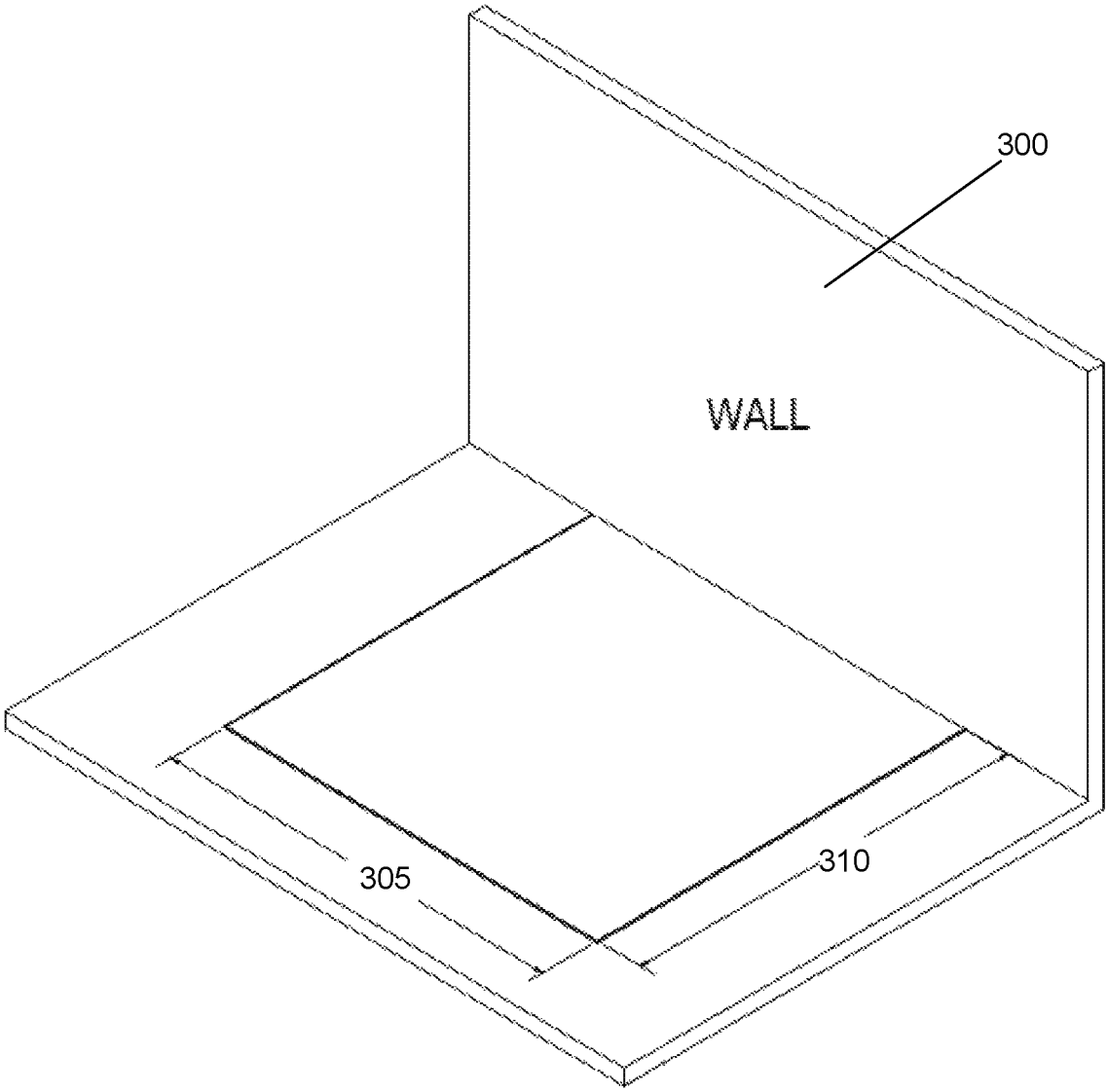
FIG. 3 illustrates an isometric view of a structural wall that may be coupled to one or more of the improved walls of the system according to an exemplary embodiment.

Referring now to FIG. 3, this figure illustrates an isometric view of a structural wall 300 that may be coupled to one or more of the improved walls 115 of the system 101 according to an exemplary embodiment. The structural wall 300 may be part of existing structure such as a building.

While only single structural wall 300 is illustrated, it is possible to form the inventive system 101 by using two or more structural walls (not illustrated). Further, it is possible to form the inventive system 101 without using any existing structural walls, such as the exemplary embodiment illustrated in FIGS. 16-17. Referring back to FIG. 3, reference numeral 305 denotes a width dimension for the cage/system 101 as illustrated in FIG. 1. The width dimension 305 for the cage/system 101 may comprise a magnitude between about 1.0 feet and about 80.0 feet.

Reference numeral 310 denotes a length dimension for the cage/system 101 as illustrated in FIG. 1. The length dimension 310 and width dimension 305 for the cage/system 101 may comprise a magnitude between about 1.0 feet and about 80.0 feet. However, other magnitudes for these width and length dimensions 305, 310 are possible and are included within the scope of this disclosure. Such other magnitudes may be larger or smaller than the ranges described above.

Figures 4A, 4B, 4C:
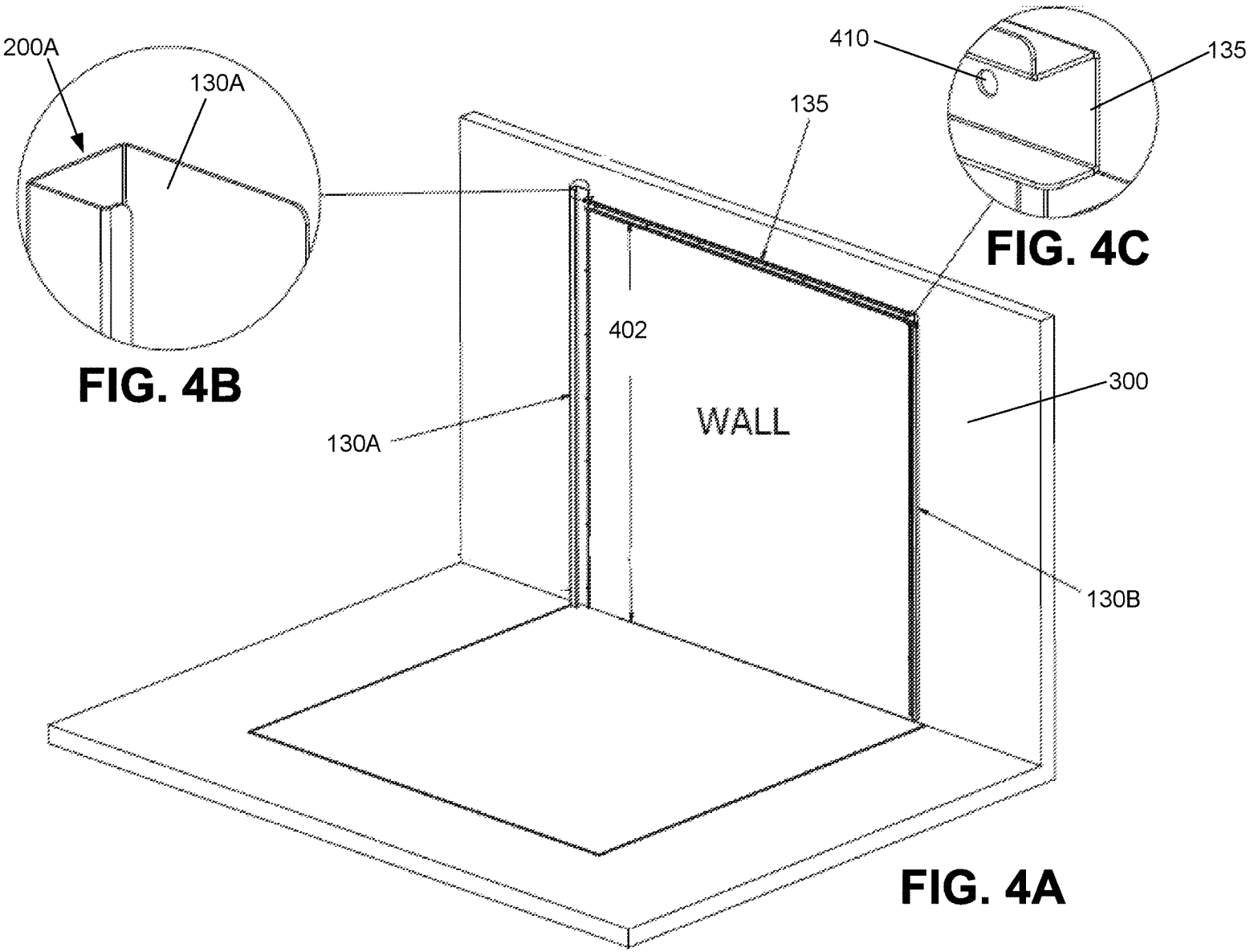
FIG. 4A illustrates another isometric view of the structural wall with additional detail according to an exemplary embodiment.
FIG. 4B illustrates a cage side wall mounting device for a structural wall according to an exemplary embodiment.
FIG. 4C illustrates cage ceiling mounting device for a structural wall according to an exemplary embodiment.

Referring now to FIG. 4A, this figure illustrates another isometric view of the structural wall 300 with additional detail according to an exemplary embodiment. This figure shows each cage side wall mounting device 130A, 130B attached to the structural wall 300. The cage side wall mounting devices 130A, 130B may be attached to the structural wall 300 with fasteners, such as, but not limited to, screws, nails, nuts, bolts, rivets, and adhesives (not illustrated) which may penetrate aperture 410. FIG. 4A also illustrates an exemplary height dimension 402 for the system 101. The height dimension 402 may have a magnitude between about 1.0 feet to about 50.0 feet. However, other magnitudes for this height dimension 402 are possible and are included within the scope of this disclosure. Such other magnitudes may be larger or smaller than the range described above.

Referring now to FIG. 4B, this figure illustrates an end view of a cage side wall mountingdevice 130A for a structural wall 300 according to an exemplary embodiment. As shown, the cage side wall mounting device 130A may have a closed facing edge 200A as defined above in connection with FIG. 2B. This closed facing edge 200A will mate/couple with an open facing edge 200B of a wall panel 115, such as the ones illustrated in FIG. 2C. Further details about this coupling will be described below.

FIG. 4C illustrates an end view of a cage ceiling mounting device 135 for a structural wall according to an exemplary embodiment. The cage ceiling mounting device 135 will engage with one or more ceiling panels 110 such as illustrated in FIGS. 1 and 2A. Fasteners (not illustrated) may penetrate aperture 410 in the cage ceiling mounting device 135 to attach the device 135 to the wall 300.

Figures 5A, 5B:
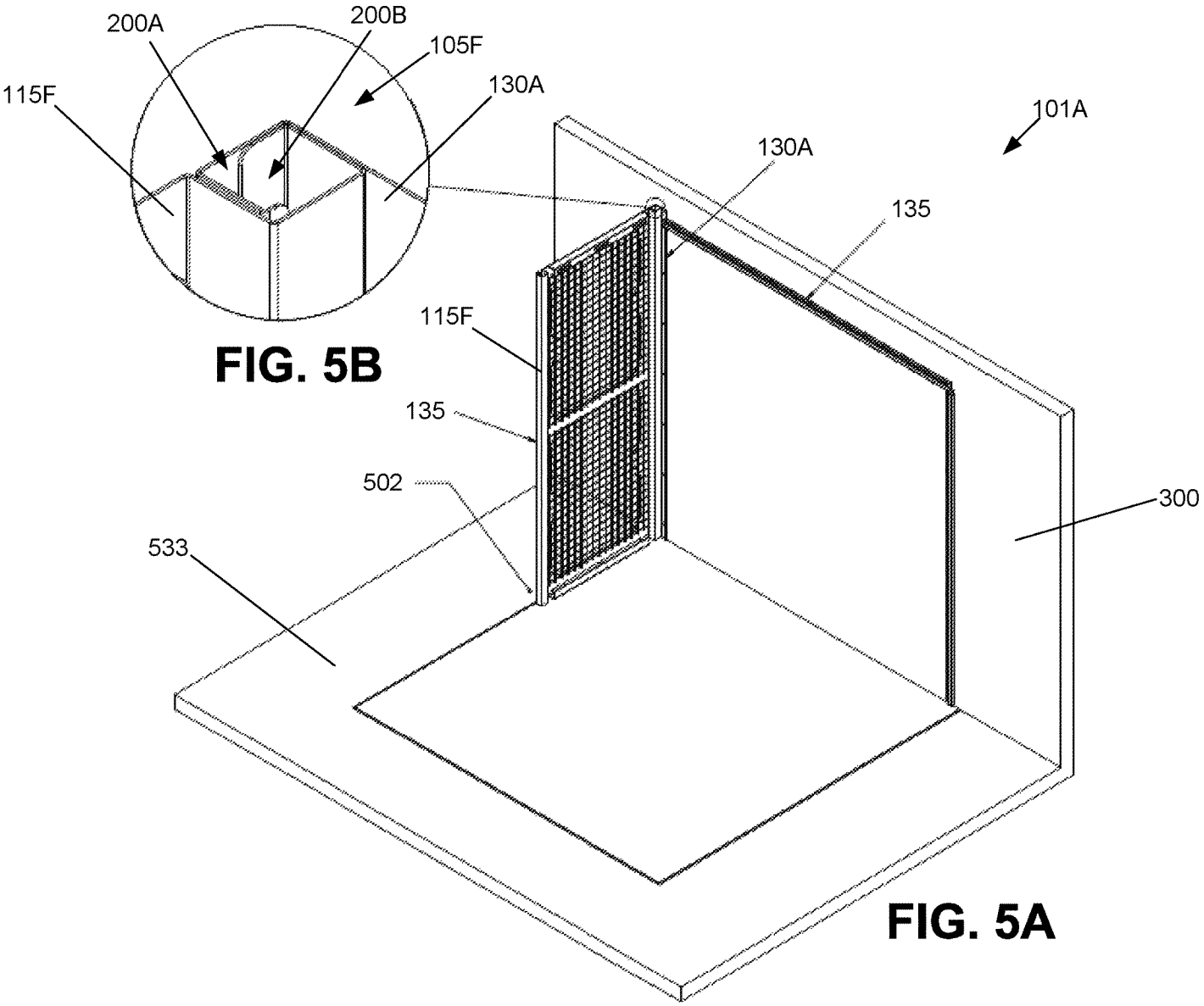
FIG. 5A illustrates the structural wall of FIG. 3 having cage side wall mounting device coupled to an improved wall panel according to an exemplary embodiment.
FIG. 5B illustrates an end view of the unique coupling between the cage side wall mounting device and the improved wall panel according to an exemplary embodiment.

Referring now to FIG. 5A, this figure illustrates the structural wall 300 of FIG. 3 having cage side wall mounting device 130A of FIG. 4B coupled to an improved wall panel 115F according to an exemplary embodiment. The wall panel 115F is also illustrated in FIG. 2A described above. The wall panel 115F has open facing edges 200B as described above in connection FIG. 2C. Meanwhile, the cage side wall mounting device 130A has a closed facing edge 200A as described above in connection with FIG. 4B. The wall panel 115F may rest on a floor 533 while it is secured to the cage side wall mounting device 130A. The wall panel 115F may form a portion of the square-shaped perimeter 502 that is shown in FIG. 5A which corresponds to an outer portion that the completed cage 101 will occupy once it is fully constructed.

Figure 7A:
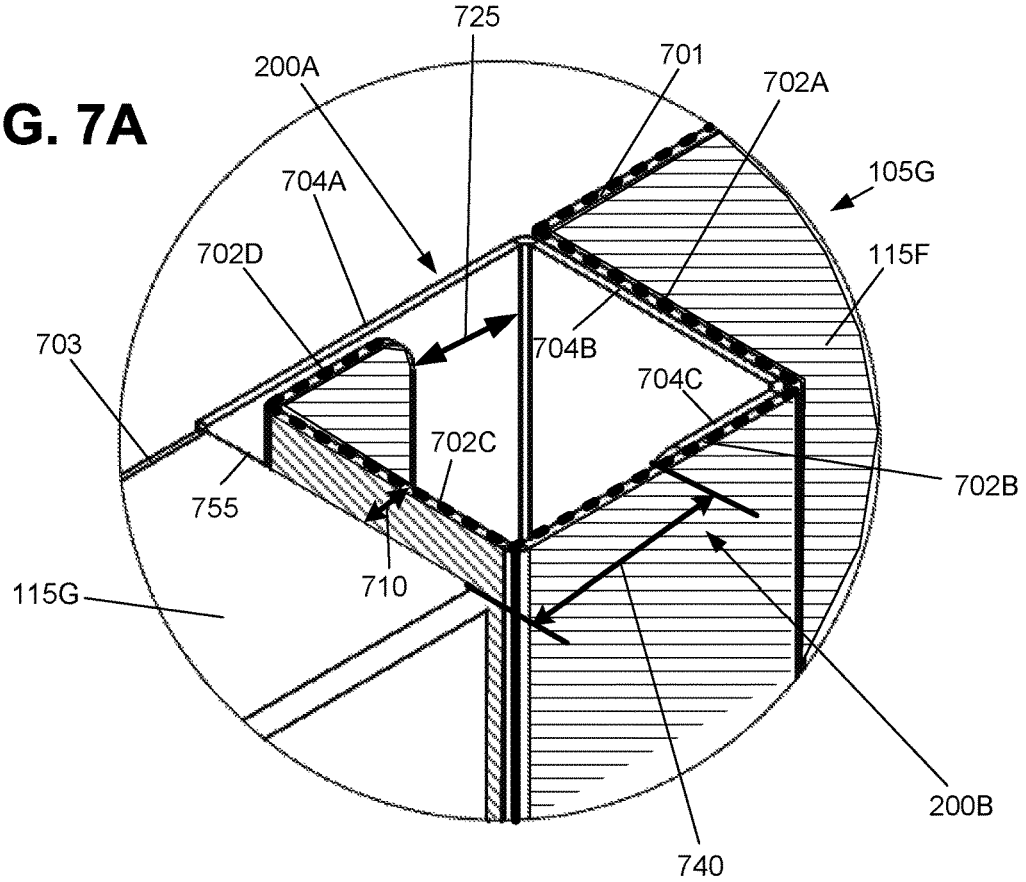
FIG. 7A illustrates an enlarged isometric view of the coupling between two side improved walls according to an exemplary embodiment.
Figure 7B:
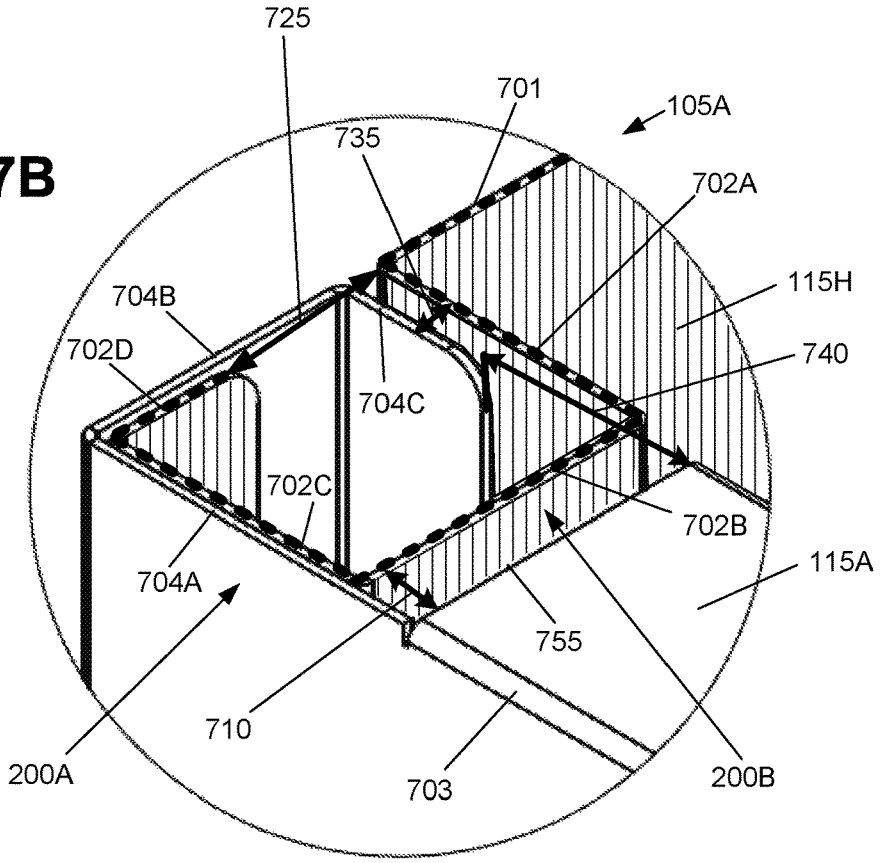
FIG. 7B illustrates an enlarged isometric view of the coupling between a side wall and a front wall which form a corner section of a security cage according to an exemplary embodiment.

Referring now to FIG. 5B, this figure illustrates an end view of the unique coupling 105F between the cage side wall mounting device 130A and the improved wall panel 115F according to an exemplary embodiment. As noted above in connection with FIG. 5A, the cage side wall mounting device 130A has a closed facing edge 200A which mates with the open facing edge 200B of the improved wall panel 115F. Further details of this unique coupling 105F and other unique couplings 105 that are formed by the closed and open facing edges 200A, 200B will be described in further detail below, such as illustrated in FIGS. 7A-7B.

Figures 6A, 6B, 6C, 6D, 6E:
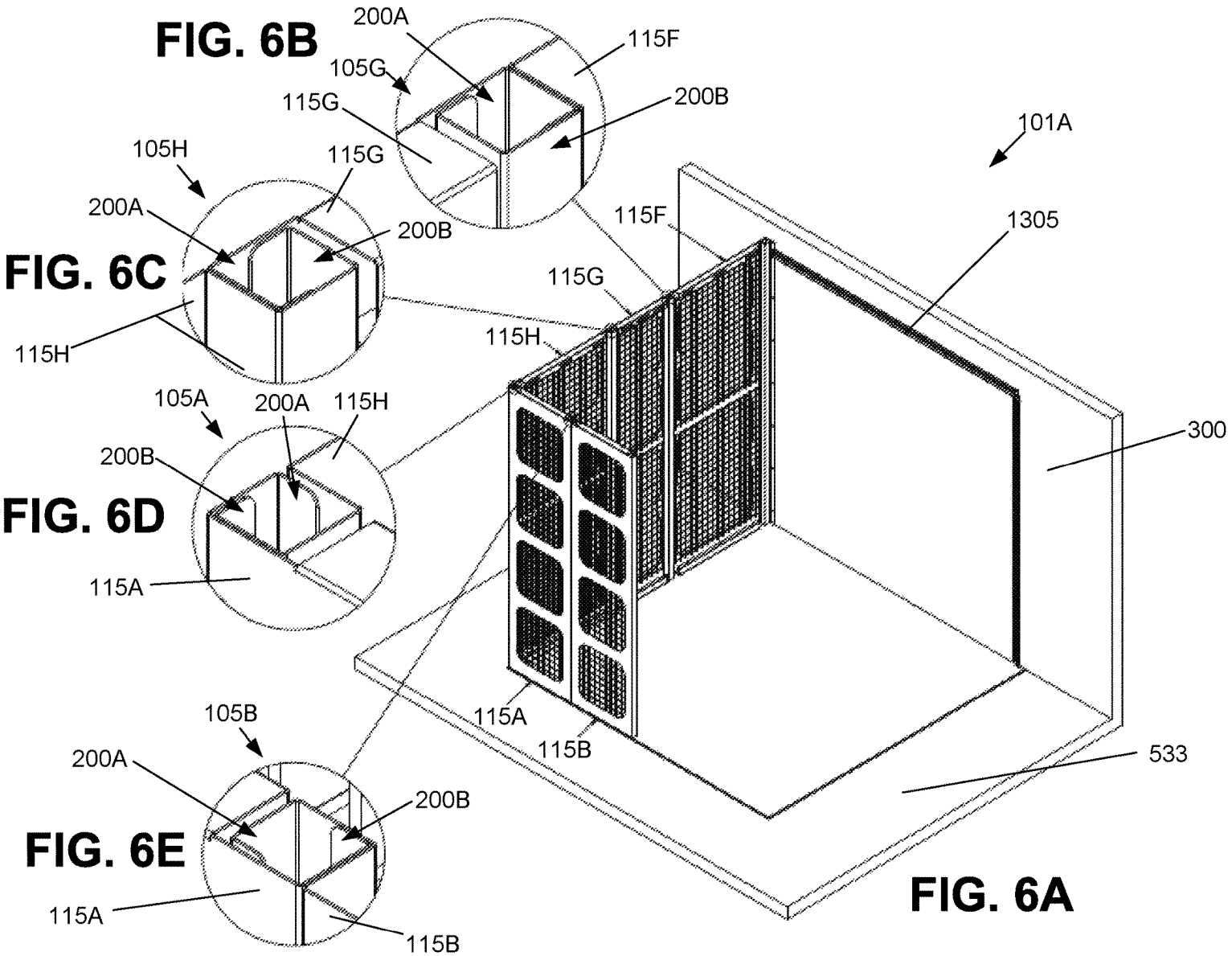
FIG. 6A illustrates the structure wall of FIG. 5A but with additional improved walls being coupled together to form a partially completed security cage according to an exemplary embodiment.
FIG. 6B illustrates an end isometric view of the coupling between two improved side walls according to an exemplary embodiment.
FIG. 6C illustrates an end isometric view of the coupling between two improved walls according to an exemplary embodiment.
FIG. 6D illustrates an end isometric view of the coupling between a side wall and front wall which forms a corner section of the security cage according to an exemplary embodiment.
FIG. 6E illustrates an end isometric view of the coupling between two improved front walls according to an exemplary embodiment.

FIG. 6A illustrates the structural wall of FIG. 5A but with additional improved walls/wall panels 115 being coupled together to form a partially completed security cage 101 according to an exemplary embodiment. FIG. 5A illustrates how a second wall panel 115G was fastened to the first wall panel 115F via coupling 105G (illustrated in FIG. 6B). Next, a third wall panel 115H was fastened to the second wall panel 115G via coupling 105H (illustrated in FIG. 6C).

Subsequently, a fourth, front wall panel 115A was fastened to the third wall panel 115H via coupling 105A (illustrated in FIG. 6D). A fifth, front wall panel 115B was fastened to the fourth wall panel 115A via coupling 105B (illustrated in FIG. 6B). It is noted that the sequence of coupling the wall panels 115 illustrated in FIGS. 6A-6E together is preferred. However, the sequence of coupling the wall panels 115 together is not limited to that shown here in FIGS. 6A-6E. It is possible to randomly couple wall panels 115 together without following this sequence without departing from the scope of this disclosure. The unique couplings 105 between the respective wall panels 115 of FIGS. 6A-6E generally correspond to the couplings depicted and described in connection with FIG. 1 mentioned above.

Referring now to FIG. 6B, this figure illustrates an end isometric view of the coupling 105G between two improved side wall panels 115F, 115G according to an exemplary embodiment. As shown, the first wall panel 115F has open facing edge 200B while the second wall panel 115G has a closed facing edge 200A. Further details of this unique coupling 105G and other unique couplings 105 that are formed by the closed and open facing edges 200A, 200B will be described in further detail below, such as illustrated in FIGS. 7A-7B.

As noted previously, the geometry of an edge 200 for a wall panel 115 may be changed as desired. That is, the geometry of an edge 200, whether closed facing 200A or open facing 200B, may be selected irrespective of the size of the wall panel 115. Generally, most wall panels 115 will have identical edges 200 having the same geometry. However, it is not beyond this disclosure to manufacture a wall panel 115 which has two different geometries for its two edges 200 what couple with other wall panels 115.

Referring now to FIG. 6C, this figure illustrates an end isometric view of the coupling 105H between two improved wall panels 115G, 115H according to an exemplary embodiment. As shown, the second wall panel 115G has a closed facing edge 200A while the third wall panel 115H has an open facing edge 200B. Further details of this unique coupling 105H and other unique couplings 105 that are formed by the closed and open facing edges 200A, 200B will be described in further detail below, such as illustrated in FIGS. 7A-7B.

Referring now to FIG. 6D, this figure illustrates an end isometric view of the coupling 105A between the third side wall panel 115H and a front wall panel 115A which forms a corner section of the security cage 1010 according to an exemplary embodiment. As shown, the third wall panel 115H has an open facing edge 200B while the first, front wall panel 115A has a closed facing edge 200A. Further details of this unique coupling 105A and other unique couplings 105 that are formed by the closed and open facing edges 200A, 200B will be described in further detail below, such as illustrated in FIGS. 7A-7B.

Referring now to FIG. 6E, this figure illustrates an end isometric view of the coupling 105B between two improved front walls 115A, 115B according to an exemplary embodiment. As shown, the first front wall panel 115A has a closed facing edge 200A while the second front wall panel 115B has an open facing edge 200B. Further details of this unique coupling 105B and other unique couplings 105 that are formed by the closed and open facing edges 200A, 200B will be described in further detail below, such as illustrated in FIGS. 7A-7B.

Referring now to FIG. 7A, this figure illustrates an enlarged isometric view of the coupling 105G between two side improved wall panels 115F, 115G of FIG. 6B according to an exemplary embodiment. This view of FIG. 7A compared to FIG. 6B shows the first wall panel 115F shaded with slanted cross-hatching so that its open facing edge geometry 200B is easily detected/distinguished from the closed facing edge geometry 200A of the second wall panel 115G. Further, the top portions 702 of the open facing edge geometry 200B of the first wall panel 115F has been highlighted with dashed lines to distinguish it/separate it from the top portions 704 of the closed facing edge geometry 200A of the second wall panel 115G.

The first wall panel 115F has a top edge 701 that is coupled to the open facing edge 200B. The open facing edge 200B comprises a first top edge portion 702A, a second top edge portion 702B, a third top edge portion 702C, and a fourth edge top edge portion 702D. According to the exemplary embodiment of the open facing edge 200B, each top edge portion 702 is at right angles relative to each other. Further, the first top edge portion 702A and the second top edge portion 702B may have a length and where each length is substantially the same or identical relative to each other. Meanwhile, the third top edge portion 702C and fourth top edge portion 702D each may have a length and where each length is less than the length of either the first top edge portion 702A and/or the second top edge portion 702B. The fourth top edge portion 702D may also have a length which is less than a length of the third top edge portion 702C.

The length of the fourth top edge portion 702D of the open facing edge 200B is usually less than each length of the first top edge portion 702A, the second top edge portion 702B, and the third top edge portion 702C. Generally, the length of the fourth top edge portion 702D is usually less than half the length for the first, second, and third top edge portions 702A, 702B, 702C of the open facing edge 200B.

Because the length of the fourth top edge portion 702D is less than the lengths of the other top edge portions 702A, 702B, 702C, a gap or opening 725 exists between the fourth top edge portion 702D and the first top edge portion 702A. This opening 725 is the reason why the four top edge portions 702A-702D are characterized as forming the open facing geometry 200B which was also described above in connection with FIGS. 2B-2C.

Within this gap or opening 725, the second top edge portion 704B and the third top edge portion 704C [described below] of the closed facing edge 200A may pass through so that the second top edge portion 704 of the closed facing edge 200A is positioned adjacent to the first top edge portion 702A of the open facing edge 200B and so that the third top edge portion 704C of the of the closed facing edge 200A is positioned adjacent to the second top edge portion 702B of the open facing edge 200B. This also allows the fourth top edge portion 702D of the open facing edge 200B to be positioned adjacent to in with a first top edge portion 704A of the closed facing edge 200A. The surface or plane below each fourth top edge portion 702D and the first top edge portion 704A are in contact with one another as understood by one of ordinary skill in the art.

The second wall panel 115G has a top edge 703 that is coupled to a first portion 704A of a closed facing edge 200A. The closed facing edge 200A may be formed by three sections/portions: a first top edge portion 704A, a second top edge portion 704B, and a third top edge portion 704C. Similar to the open facing edge 200B, the three top edge portions 704A, 704B, 704C may be at ninety degrees relative to each other.

However, each of the lengths for each of the three top edge portions 704A, 704B, 704C may be different relative to each other: the first top edge portion 704A may have a length with is greater than the length of the second top edge portion 704B and the third top edge portion 704C. The second top edge portion 704B may have a length which is less than the first top edge portion 704A but is greater than the length of the third top edge portion 704C. The third top edge portion 704C may have a length which is less than both the first top edge portion 704A and the second top edge portion 704B The third top edge portion 704C of closed facing edge 200A usually has a length that is less than the gap or opening 725 formed between the fourth top edge portion 702D and the first top edge portion 702A of the open facing edge 200B. The first top edge portion 704A of the closed facing edge 200A usually has a length which is greater than the length of the second top edge portion 702B of the open facing edge 200. With the top edge portion 704A having this length, an opening or gap 710 is usually formed between a side portion 755 of the second wall panel 115G and the third top edge portion 702C of the open facing edge 200B.

The third top edge portion 704C of closed facing edge 200A usually has a length such that a gap or opening 740 is usually formed between the top edge portion 704C and the side portion 755 of the second wall panel 115G. This gap or opening 740 usually has a length which is greater than both gaps 710, 725 of FIG. 7A. The gap or opening 740 allows the fourth top edge portion 702D and third top edge portion 702C (and their corresponding planar surfaces beneath) to pass through gap 740 during assembly of the wall panels 115F, 115G.

With this unique geometry of the coupling 105G, the fourth top edge portion 702D of the open facing edge 200B and the first top edge portion 704A of the closed facing edge 200A are firmly positioned against each other in tight facing contact (such that their planar or flat surfaces beneath these edges 702D, 704A are in contact with one another). Similarly, the second top edge portion 704B and the first top edge portion 702A as well as the third top edge portion 704C and the second top edge portion 702B are firmly positioned against each other in tight facing contact (such that their geometrical planar surfaces beneath these pairs of edges 702A, 704B and 704C, 702B are in contact with one another). This means that three sections of each edge 200A, 200B are in tight and direct contact with one another.

Because of this close contact between portions 702, 704 of the closed facing edge 200A and open facing edge 200B, a firm connection or coupling is formed between the first and second wall panels 115F, 115G. This coupling 105G allows the first and second wall panels 115F, 115G to be coupled together in a tight and firm fashion and without the need of numerous fasteners compared to conventional wall panels.

The unique geometry for the unique coupling 105G illustrated in FIG. 7A, may also be rotated about or exactly ninety (90.0) degrees so that coupling 105G may also serve as a corner for the cage system 101. Such a rotation of one wall panel 115 relative to another panel 115 would form a corner of the cage system 101 similar to the corner of FIG. 7B described below. This is also one unique aspect of the inventive cage system 101.

Referring now to FIG. 7B, this figure illustrates an enlarged isometric view of the coupling 105A between a side wall panel 115H and a front wall panel 115A which form a corner section/corner coupling of a security cage according to an exemplary embodiment. This corner coupling 105A is also illustrated in FIG. 6D described above. The coupling of FIG. 7B is very similar to the coupling of FIG. 7A. Therefore, only the differences between these two figures will be described below.

According to this exemplary embodiment, for this exemplary corner coupling 105A, the side wall panel 115H has an open facing edge 200B, while the front wall panel 115A has a closed facing edge 200A. In this exemplary embodiment, only two sets of edge portions 702, 704 are in direct and closed facing contact with each other compared to the three edge portions 702, 704 of the coupling 105G of FIG. 7A.

Specifically, the fourth edge portion 702D of the open facing edge 200B of side wall panel 115H comes in direct and closed facing contact with the second edge portion 704B of the closed facing edge 200A of front wall panel 115A. Similarly, the third edge portion 702C of the open facing edge 200B of side wall panel 115H comes in direct and closed facing contact with the first edge portion 704A of the closed facing edge 200A of front wall panel 115A.

In this exemplary wall coupling 105A, in addition to a first gap or opening 710 being formed between the second edge portion 702B of the open facing edge 200B and a side portion 755 of the front wall panel 115A, a second gap 735 is formed between the third edge portion 704C of the closed facing edge 200 and the first edge 702A of the open facing edge 200B.

With the direct and close facing contact among the two sets of edge portions 702D & 704B, 702C & 704A, a tight and rigid corner coupling 105A is formed without the need for additional fasteners or attachment mechanisms (i.e. welds or glue) compared to other cage systems of the conventional art. With the reduction and/or elimination of fasteners of the system 101, the system 101 is easily constructed and can be constructed much more efficiently and rapidly compared to other conventional cages which require fasteners and/or attachment mechanisms between respective wall panels 115.

It is noted that the couplings 105 of all the figures allow for rapid assembly of the cage system 101 since the open and closed facing edges 200A, 200B may be formed by rotating and/or maneuvering the wall panels 115 together by rotating edges 200 relative each other. That is, during assembly of cage system 101, the wall panels 115 may be rotated/turned such that an closed facing edge 200A and open facing edge 200B may be coupled together to form each coupling 105 by slidingly engaging the respective edge portions 702, 704 with each other prior to their intended, final positions (whether to form a coupling 105 for a 180.0 degree connection, such as coupling 105G of FIG. 7A, or for a 90.0 degree connection—a corner of the cage system 101—such as coupling 105A of FIG. 7B).

Figures 8A, 8B, 8C, 8D, 8E:
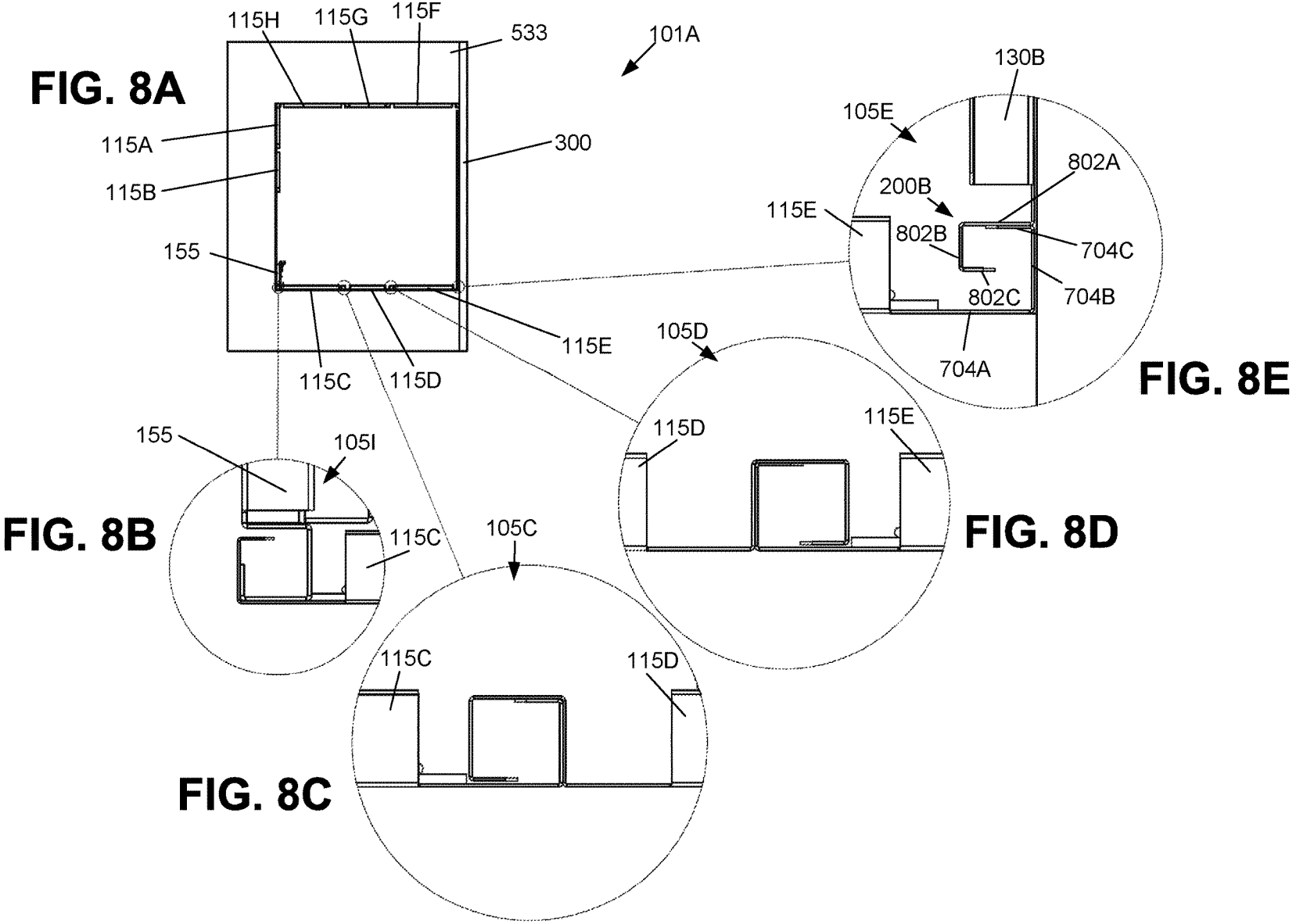
FIG. 8A illustrates a top view of the security cage of FIG. 5A, but with additional improved walls being coupled to the structural wall according to an exemplary embodiment.
FIG. 8B illustrates a top view of the coupling between a side wall and front wall which forms a corner section of the security cage according to an exemplary embodiment.
FIG. 8C illustrates a top view of the coupling between two improved side walls according to an exemplary embodiment.
FIG. 8D illustrates a top view of the coupling between two improved side walls according to an exemplary embodiment.
FIG. 8E illustrates a top view of the coupling between a side wall and the fastening mechanism for the structural wall according to an exemplary embodiment.

Referring now to FIG. 8A, this figure illustrates a top view of the security cage/system 101 of FIG. 5A and FIG. 6A, but with additional improved wall panels 115 being coupled to the structural wall 300 according to an exemplary embodiment. In this exemplary embodiment, additional wall panels 155, 115C, 115D, and 115E have been added relative to FIG. 6A. As noted previously, while structural wall 300 forms part of the cage/system 101, according to other exemplary embodiments, such as those illustrated in FIGS. 16-17 described in further detail below. Also, as noted previously, more than one structural wall 300, such as on the order of two or three existing structural walls 300, may also be utilized without departing from the scope of this disclosure.

FIG. 8B illustrates a top view of the coupling 105*i* between a side wall panel 115C and front wall panel 155 which forms a corner section of the security cage/system 101 according to an exemplary embodiment. As illustrated, the front wall panel 155 has an open edge geometry 200B while the side wall panel 115C has a closed edge geometry 200A. As visible in FIG. 9 and FIG. 15 (described in further detail below), the front wall panel 155 only has one coupling edge 200A. As noted previously, each wall panel 115 generally has two sets of identical edge geometries 200, either open facing edge geometry 200B or closed facing edge geometry 200A.

However, some wall panels 115, 155, like front wall panel 155 may have only one edge geometry 200. And as described previously (and not illustrated), it is possible to manufacture wall panels 115 or 155 which have opposite pairs of edge geometries, such as a closed facing edge geometry 200A being present on the same panel with an open facing edge geometry 200B. Further, single edge panels 115, 155, like front panel 155, may be made with either the closed facing edge geometry 200A or the open facing edge geometry 200B as understood by one of ordinary skill in the art.

Referring now to FIG. 8C, this figure illustrates a top view of the coupling 105C between two improved side wall panels 115C, 115D according to an exemplary embodiment. As shown, side wall panel 115C has a closed facing edge geometry 200A while side wall panel 115D has an open facing edge geometry 200B.

Referring now to FIG. 8D, this figure illustrates a top view of the coupling 105D between two improved side wall panels 115D, 115E according to an exemplary embodiment. As shown, side wall panel 115D has an open facing edge geometry 200B while side wall panel 115E has a closed facing edge geometry 200A.

Referring now to FIG. 8E, this figure illustrates a top view of the coupling 105E between side wall panel 115E and cage side wall panel mounting device 130B according to an exemplary embodiment. As shown, the side wall panel 115E has a closed facing edge geometry 200A while the cage side wall panel mounting device 130B has a unique open facing edge geometry 200B. The unique open facing edge geometry 200B for the side wall panel mounting device 130B is different compared to the open facing edge geometry 200B of FIGS. 7A-7B.

For the open facing edge geometry 200B of FIG. 8E, this geometry 200B has only three edge portions 802A, 802B, 802C compared to the edge portions 702A, 702B, 702C, 702D of FIGS. 7A-7C. Like FIGS. 7A-7C, the three edge portions 802A, 802B, and 802C are at substantially 90.0 degree angles relative to each other. As illustrated in FIG. 8E, the first edge portion 802A has a length which is greater than the lengths of the second and third edge portion 802B, 802C.

Further, the third edge portion 802C of FIG. 8E has a length which is shortest relative to the lengths of the first and second edge portion 802A, 802B. According to the open facing edge geometry 200B of FIG. 8E, only one edge portion of each mating edge geometry 200A, 200B has direct contact with each other. As illustrated, only the third edge portion 704C of the closed facing edge geometry 200A of side wall panel 115E has direct contact with the first edge portion 802A of the open facing edge portion 200B of FIG. 8E.

Figure 9:
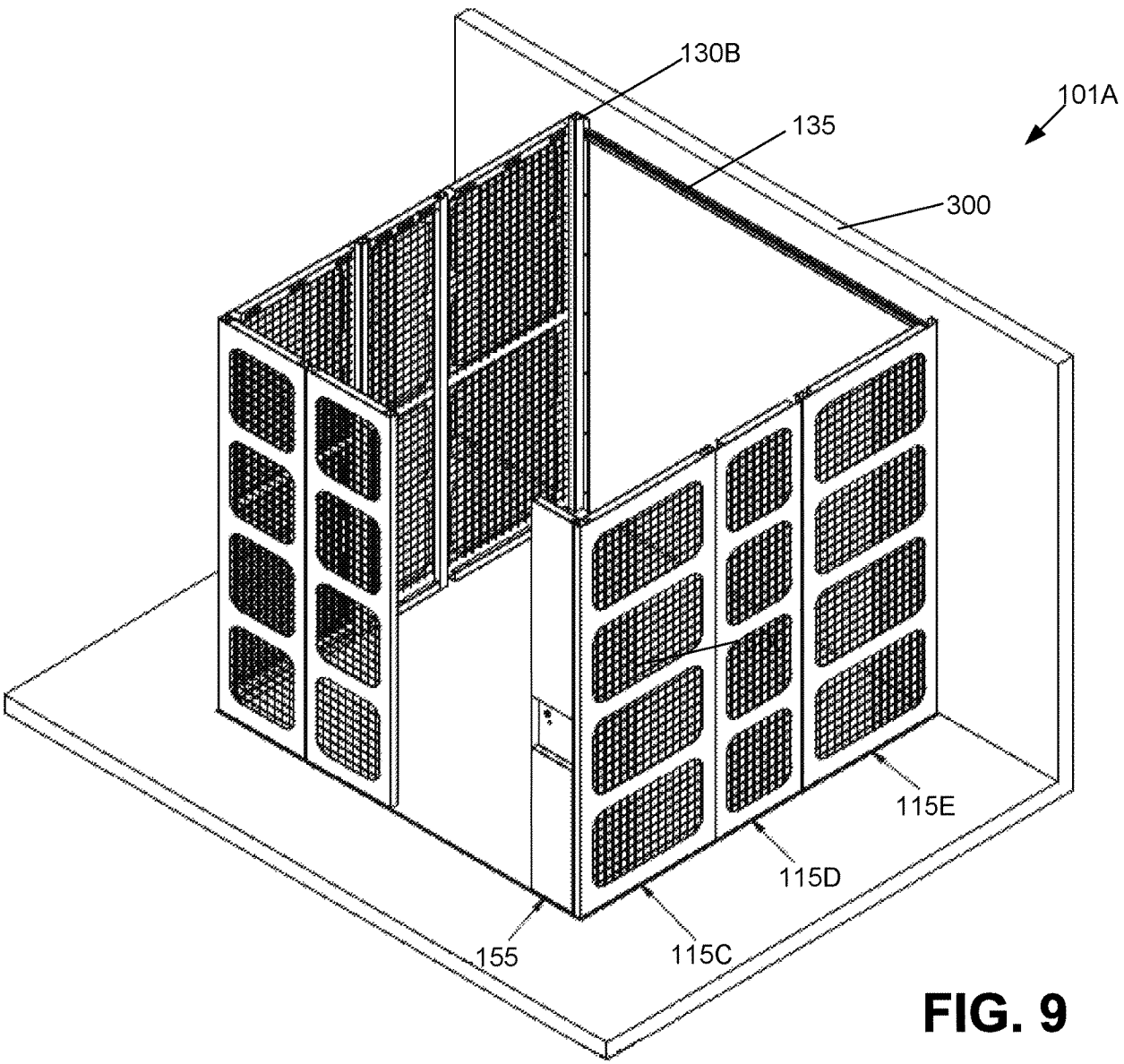
FIG. 9 illustrates an isometric side view of a partially completed security cage according to an exemplary embodiment.

FIG. 9 illustrates an isometric side view of a partially completed security cage/system 101 according to an exemplary embodiment. According to this exemplary embodiment and compared to the exemplary embodiment of FIG. 6, the front wall panel 155 and three side wall panels 115C, 115D, 115E have been installed/been joined together by their respective couplings 105I, 105C, 105D, 105E which have been illustrated in FIGS. 8B-8E and described in detail above.

Figure 10:
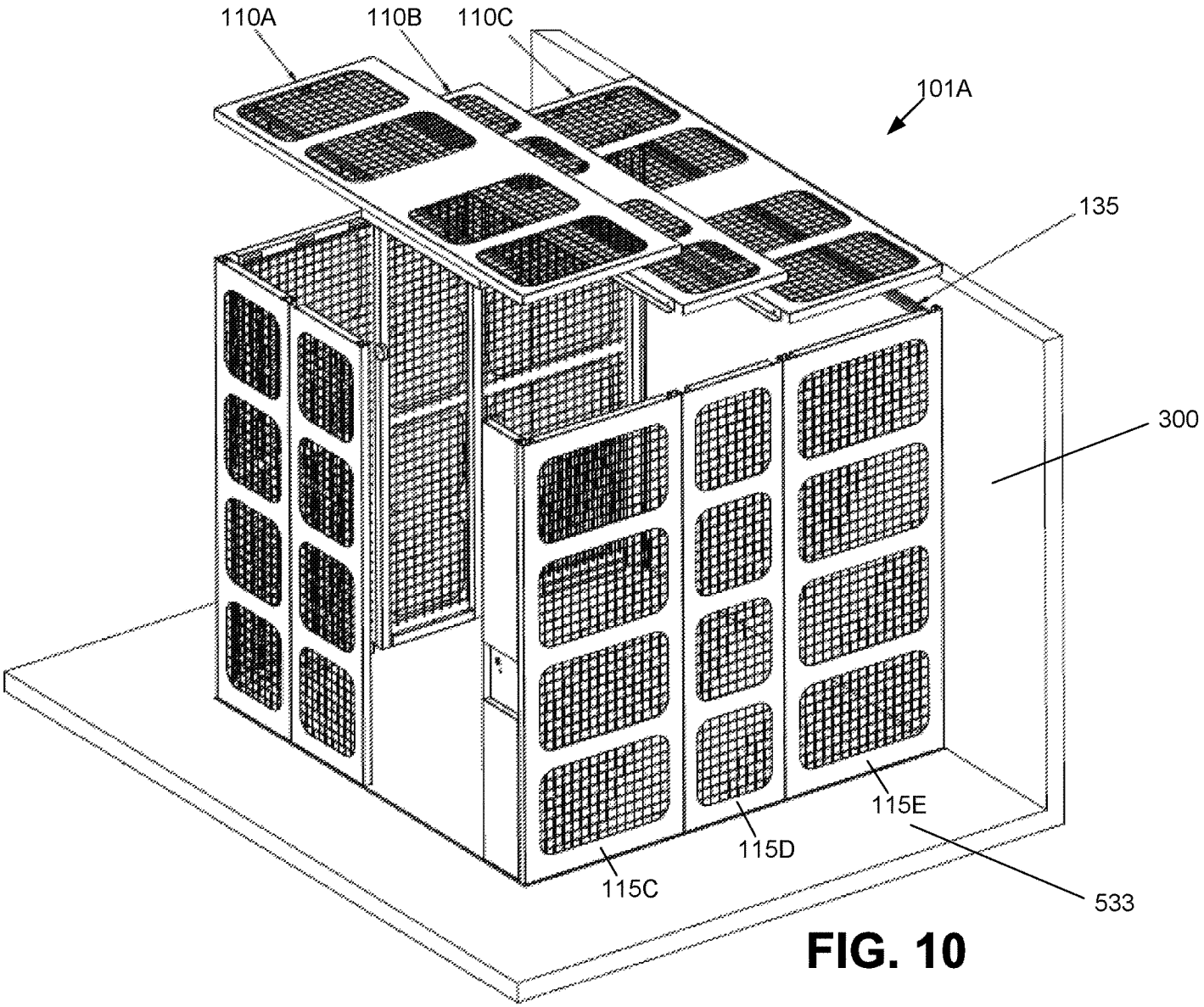
FIG. 10 illustrates an isometric side view of the security cage of FIG. 9, but with roof sections of the security cage being partially attached to the side walls according to an exemplary embodiment.

FIG. 10 illustrates an isometric side view of the security cage/system 101A of FIG. 9, but with roof sections 110A, 110B, 110C of the security cage/system 101A being partially attached to the side wall panels 115 according to an exemplary embodiment. According to this exemplary embodiment, each roof section 110 may have a width which mirrors a width dimension of its corresponding side wall panel 115. Specifically, the first roof section 110A may have a width which mirrors/is identical to a width of the first wall panel 115C. Similarly, the second roof section 110B may have a width which mirrors/is identical to a width of the second wall panel 115D and so-on.

Figure 11B:
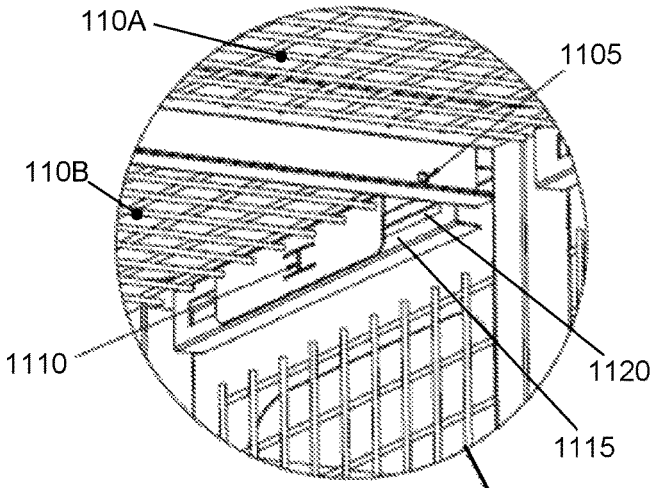
FIG. 11B is an enlarged view of the roof to ceiling coupling illustrated in FIG. 11A according to an exemplary embodiment.
Figure 11C:
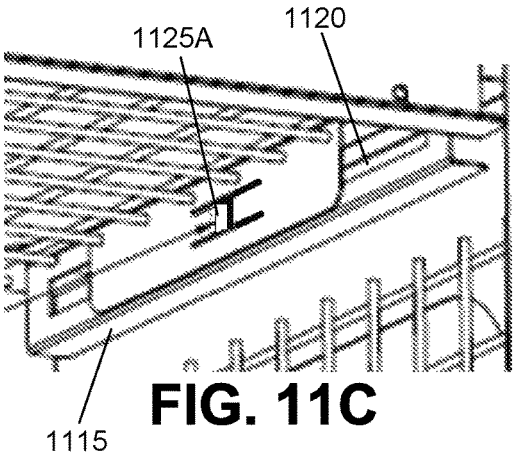
FIG. 11C illustrates how to couple a roof panel to a wall panel 115 with a unique coupling device according to one exemplary embodiment of the invention.
Figure 11D:
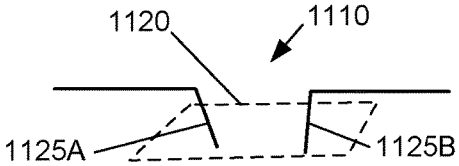
FIG. 11D illustrates how two tabs of an H-Shaped groove of the unique coupling device of FIG. 11C may be pushed or knocked into a channel by hand or with a tool such as a hammer or bottom of a screw driver.
Figure 11A:
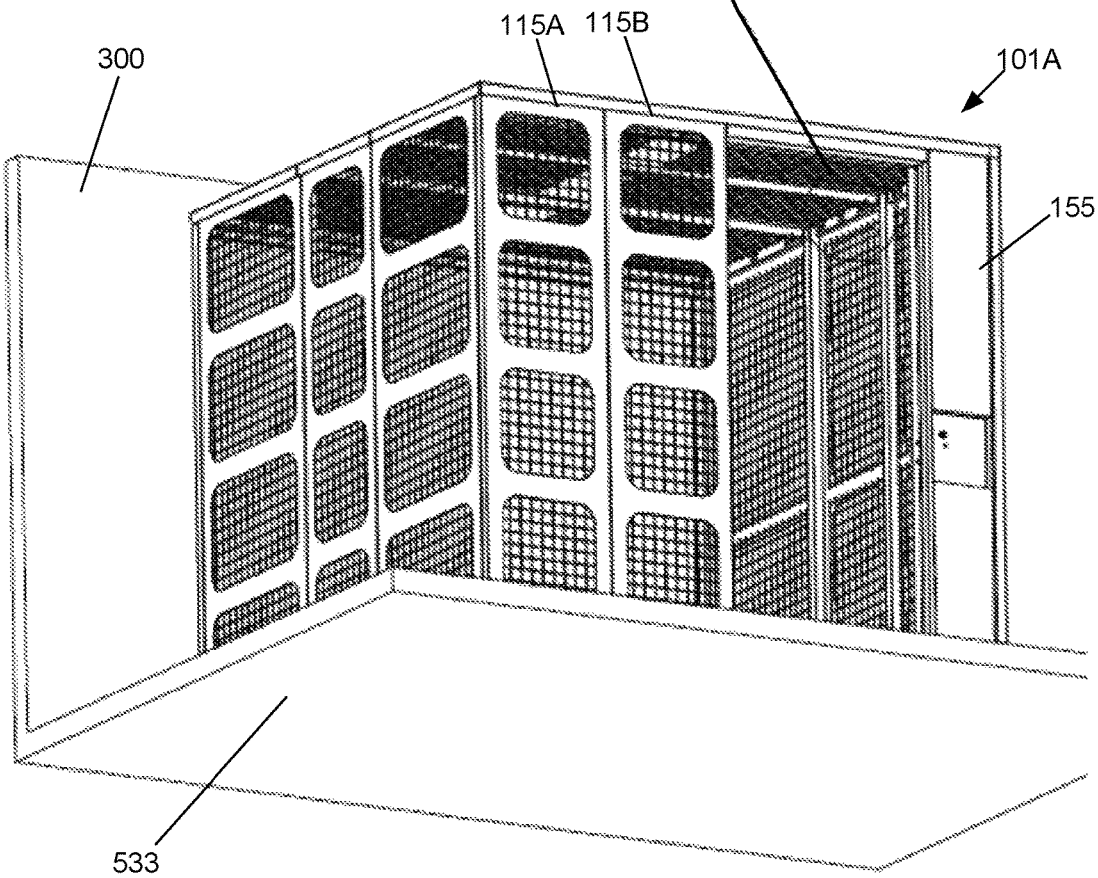
FIG. 11A illustrates an isometric bottom view of the security cage of FIG. 10, but with the roof sections being completely fastened to the side walls according to an exemplary embodiment.

FIG. 11A illustrates an isometric bottom view of the security cage of FIG. 10, but with the roof sections 110 being completely fastened to the side wall panels 115 according to an exemplary embodiment. FIG. 11B is an enlarged view of the roof to ceiling coupling illustrated in FIG. 11A according to an exemplary embodiment.

In this FIG. 11B, an aperture 1105 is shown. Within this aperture 1105, a fastener or fastening device may be installed, such as, but not limited to, a screw, a nut with bolt, a weld, an adhesive or the like. Also illustrated in FIG. 11B is a unique coupling device 1110. The coupling device 1110 may comprise a letter "H-shape" groove that is punched into a flat piece of metal. The flat piece of metal is coupled to a roof panel 110B. This "H-shape" groove in the flat piece of metal may form at least two tabs 1125A, 1125B which may be pressed or pushed into a channel or other groove 1120 of a ceiling attachment device 1115. The ceiling attachment device 1115 may be coupled to a respective wall panel 115.

To couple a roof panel 110B to a wall panel 115, an operator may position the coupling device 1110 with the "H-shape" groove over the channel 1120 of the ceiling attachment device such as illustrated in FIG. 11C. Next, as illustrated in FIG. 11D, tabs 1125A, 1125B may be pushed or knocked into the channel 1120 by hand or with a tool such as a hammer or bottom of a screw driver. In this way, the roof panel 110B is coupled to a wall panel 115, with a reduced amount of fasteners and/or with a reduced set of tools as understood by one of ordinary skill in the art.

Figures 12A, 12B, 12C, 12D:
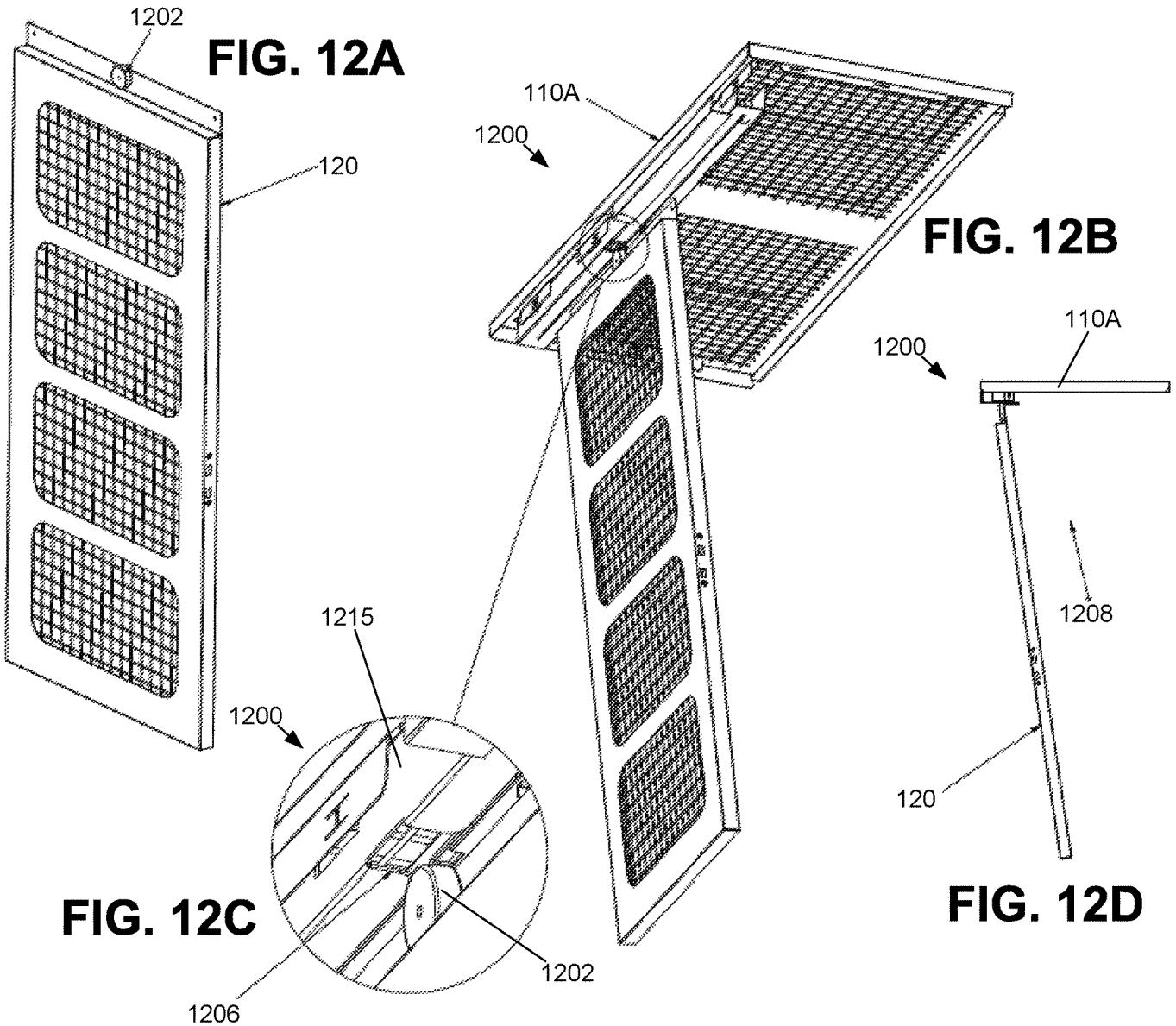
FIG. 12A is a front isometric view of a door according to an exemplary embodiment.
FIG. 12B is a front isometric view of the door and roof coupling according to an exemplary embodiment.
FIG. 12C is an enlarged view of the door and roof coupling that is illustrated in FIG. 12B according to an exemplary embodiment.
FIG. 12D is a side view of the door and roof coupling that is illustrated in FIG. 12B according to an exemplary embodiment.

Referring now to FIG. 12A, this figure is a front isometric view of a door 120 according to an exemplary embodiment. The door 120 may support a caster assembly 1202 which allows the door 120 to slide along a support beam 1215 (See FIG. 12C). Referring now to FIG. 12B, this figure is a front isometric view of the door 120 and roof coupling 1200 according to an exemplary embodiment. This figure shows how the caster assembly 1202 is positioned within the support beam 1215 (See FIG. 12C). FIG. 12C is an enlarged view of the door 120 and roof coupling 1200 that is illustrated in FIG. 12B according to an exemplary embodiment.

As illustrated in FIG. 12C, the caster assembly 1202 mounted on the door 120 may be positioned within a cutout 1206 of the support beam 1215. Once the caster assembly 1202 is positioned within the cutout 1206, the caster assembly may "ride" along the remaining portions of the support 1215 adjacent to the cutout 1206.

Referring now to FIG. 12D, this figure is a side view of the door 120 and roof coupling 1200 that is illustrated in FIG. 12B according to an exemplary embodiment. This view shows how the door 120 must be positioned to place the caster assembly 1202 within the cutout 1206 of FIG. 12C. The door 120 must be positioned at a slight angle and then elevated in the direction of directional arrow 1208.

Referring now to FIG. 13, this figure is rear isometric view of the door 120 and roof coupling according 1200 to an exemplary embodiment. In this view, additional cut-outs 1206 within the support beam 1215 are visible. These additional cut-outs 1206 may receive other caster assemblies 1202 (not visible). Generally, most doors 120 may have at least two caster assemblies 1202 to provide rolling support along support beam 1215. While the door 120 has been illustrated as a sliding door, one of ordinary skill in the art recognizes that other doors 120 are possible for the cage/system 101 and are within the scope of this disclosure. Therefore, other types of doors 120 which may open with hinges are possible and are covered by this disclosure.

Figure 13A:
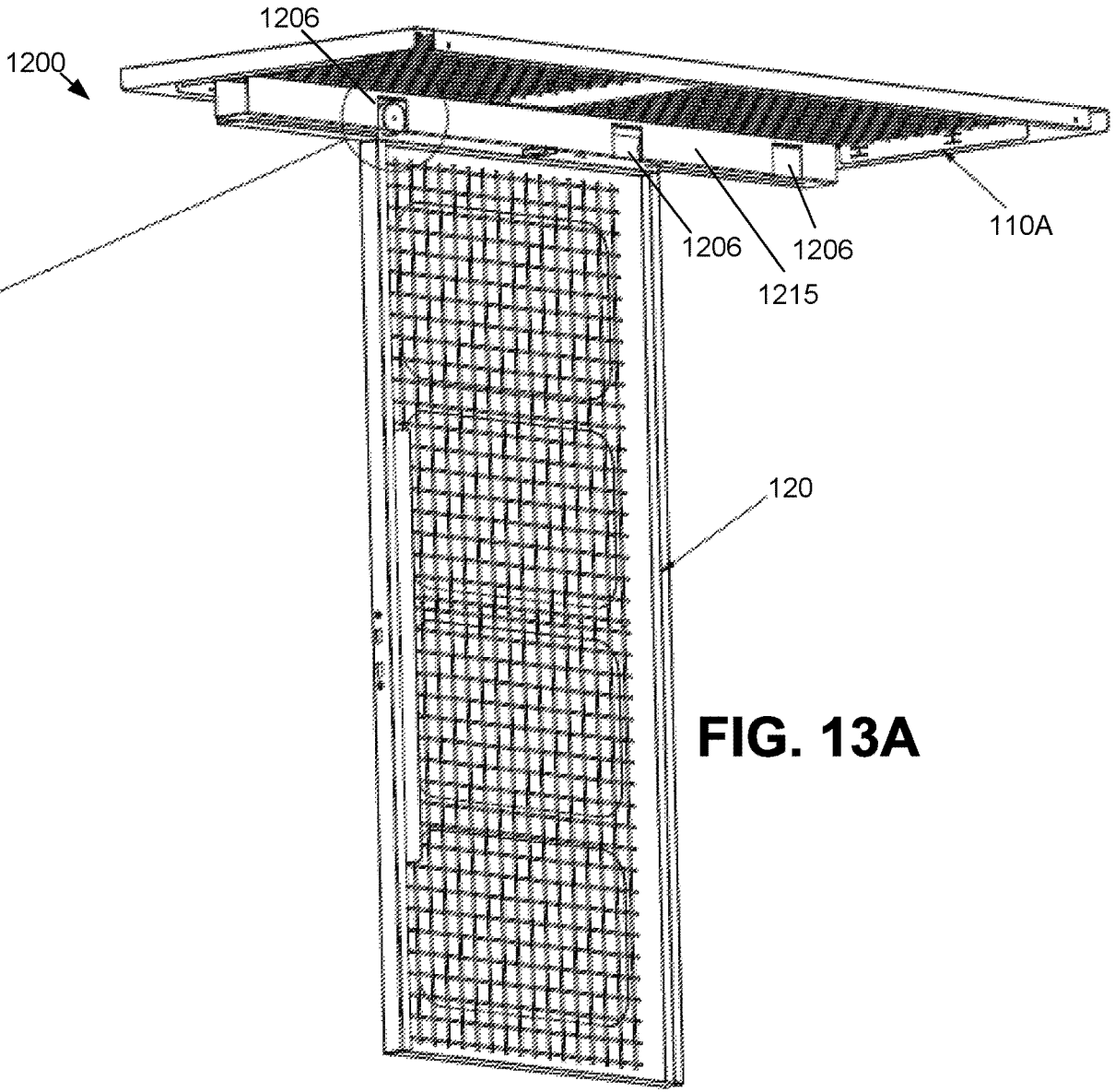
FIG. 13A is rear isometric view of the door and roof coupling according to an exemplary embodiment.
Figure 13B:
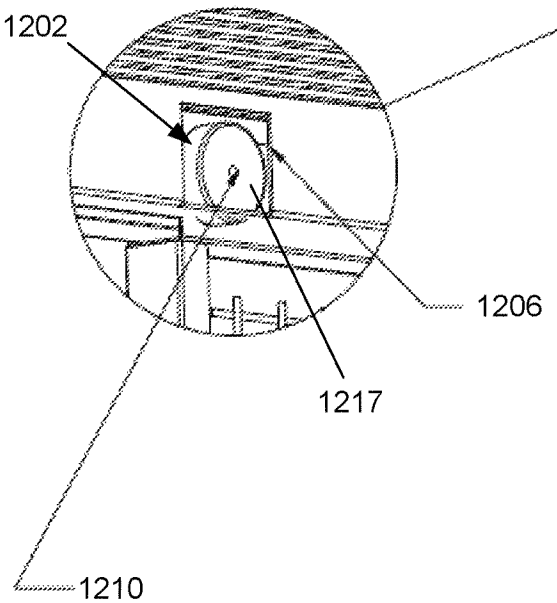
FIG. 13B is an enlarged view of the door and roof coupling that is illustrated in FIG. 13A according to an exemplary embodiment.

FIG. 13B is an enlarged view of the door 120 and roof coupling 1200 that is illustrated in FIG. 13A according to an exemplary embodiment. According to this enlarged view, a bearing sleeve 1210 for supporting the caster assembly 1202 is visible. The bearing sleeve 1210 may support a wheel 1217 which "rides" along support beam 1215.

Figure 14:
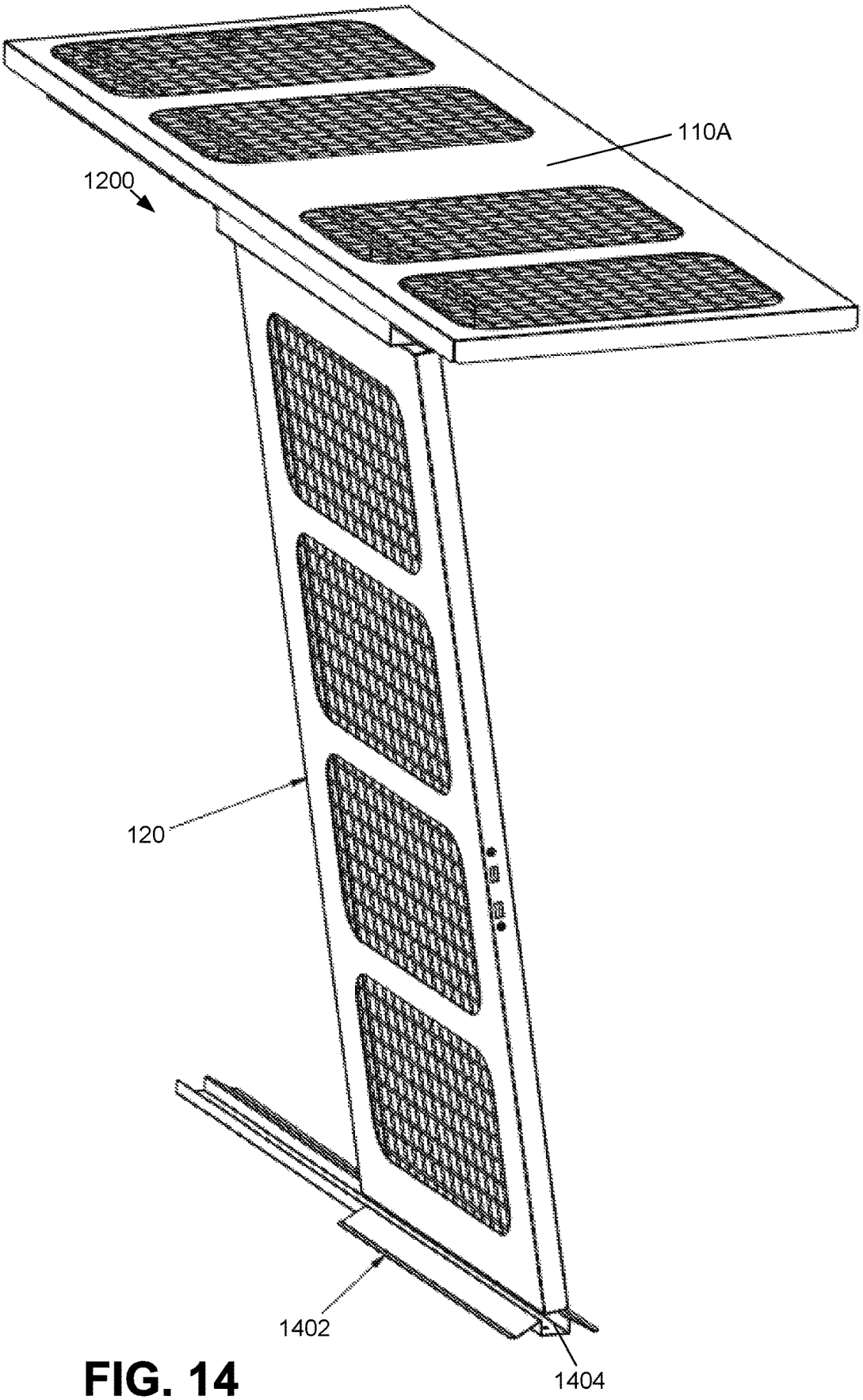
FIG. 14 is a side isometric view of the door and roof coupling and the door and bottom fastener according to an exemplary embodiment.

Referring now to FIG. 14, this figure is a side isometric view of the door 120 and roof coupling 1200 and the door 120 and bottom fastener 1402 according to an exemplary embodiment. The bottom fastener 1402 for the door 120 may comprise a sleeve that has a rectangular channel 1404 through which the door 120 may slide therethrough. The door 120 will generally not tough the bottom of the channel 1404; however, it may contact the side walls of the channel 1404 if shifted back and forth when the door 120 is slid open.

Figure 15:
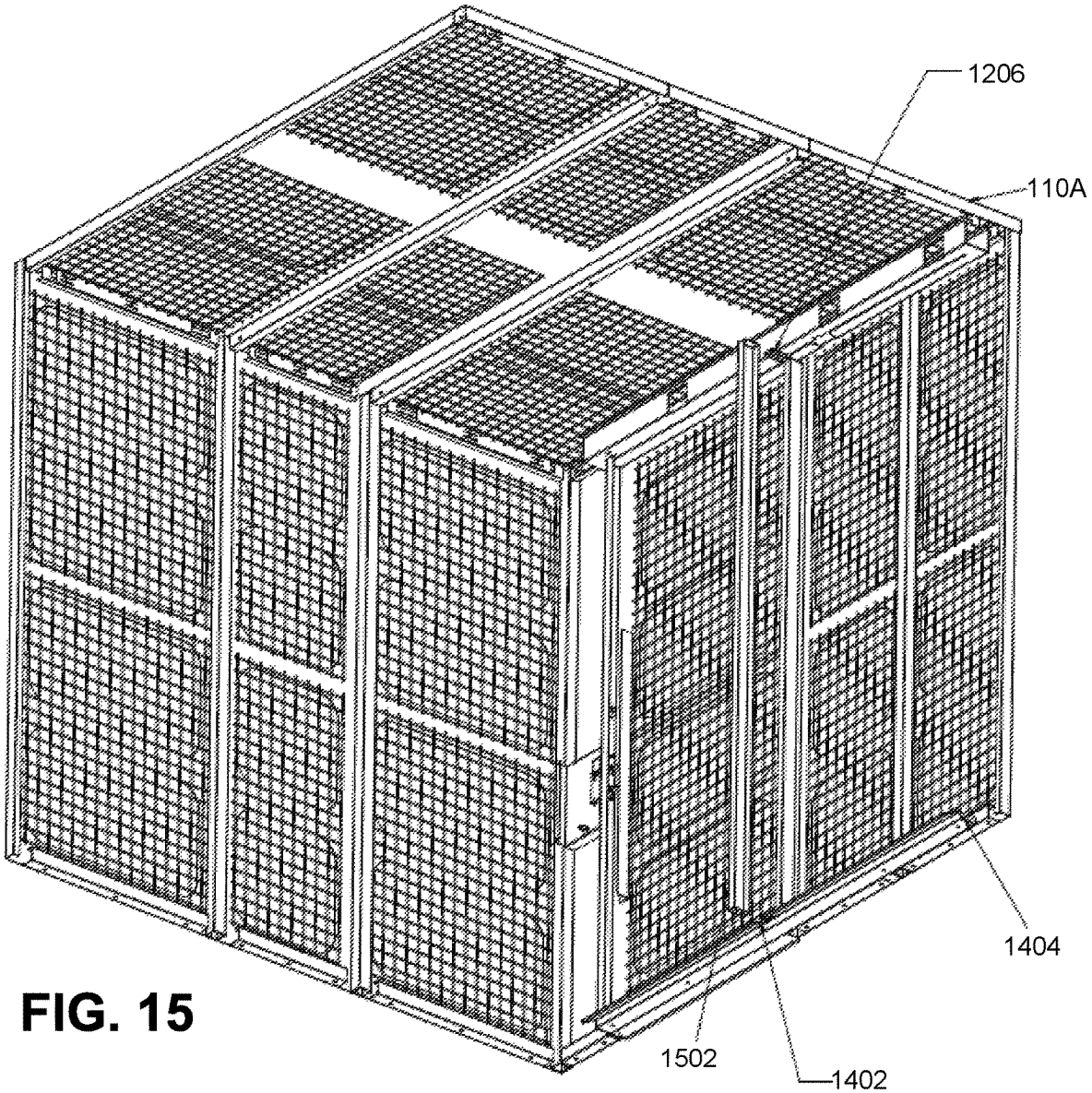
FIG. 15 is a rear isometric view of the door fully attached to the side walls and roof of the security cage according to an exemplary embodiment.

FIG. 15 is a rear isometric view of the door 120 fully attached to the side walls 115 and roof 110 of the security cage/system 101 according to an exemplary embodiment. Further illustrated in FIG. 15 is a side support beam 1502 which may be coupled to the bottom fastener 1402 for the door 120.

Figure 16:
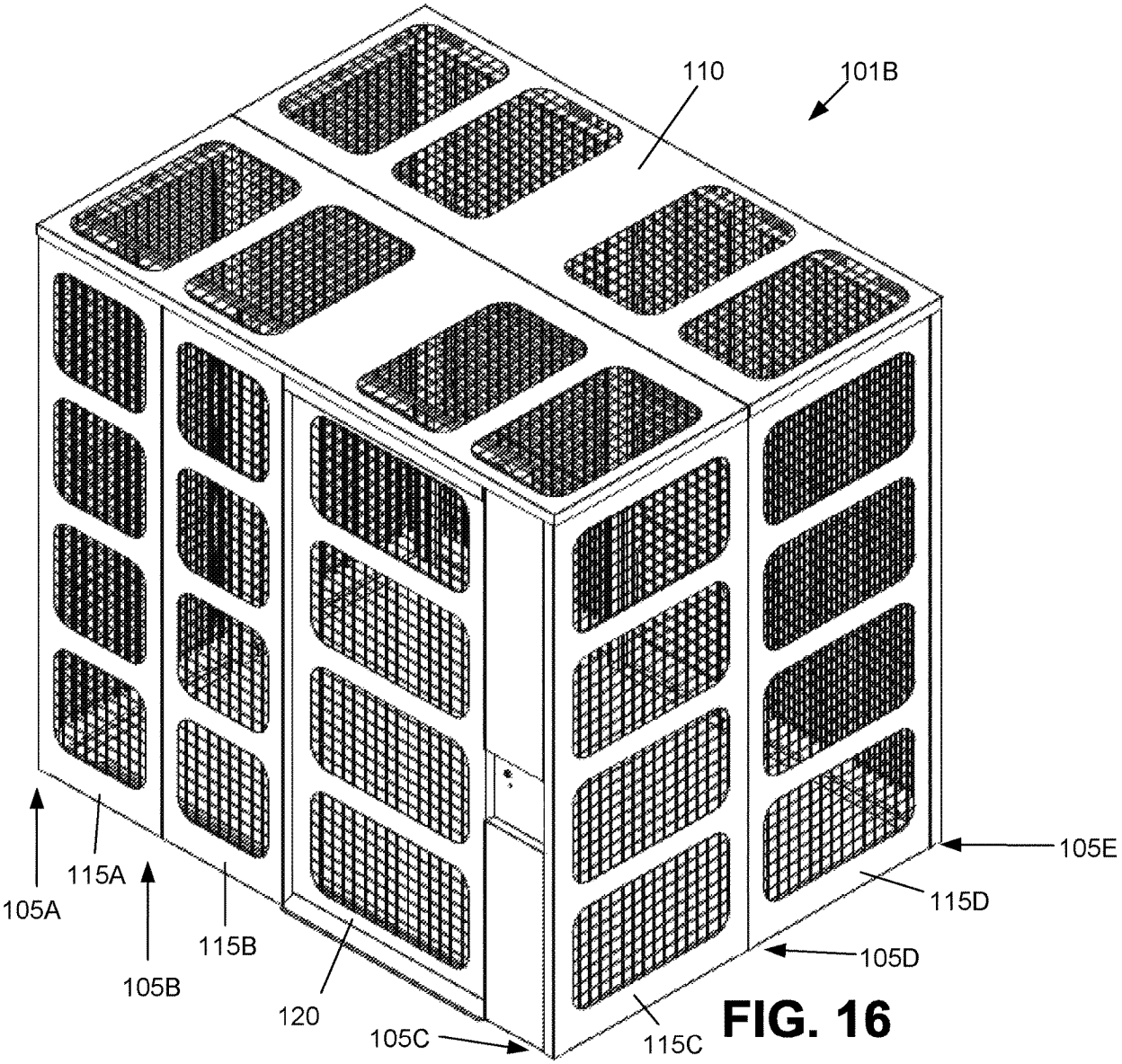
FIG. 16 is a front isometric view of another security cage with improved walls according to another exemplary embodiment.

Referring now to FIG. 16, this figure is a front isometric view of another security cage/system 101B with improved walls according to another exemplary embodiment. The security cage/system 101B is similar to the security cage/system 101A of FIGS. 1-15 so only the differences will be described here. According to this exemplary embodiment, the security cage/system 101B does not use any structural walls 300 like that of the security cage/system 101A of FIGS. 1-15. This security cage/system 101B may have unique couplings 105A-105E between side wall panels 115 which employ the open and closed facing geometries 200A, 200B described above.

Figure 17B:
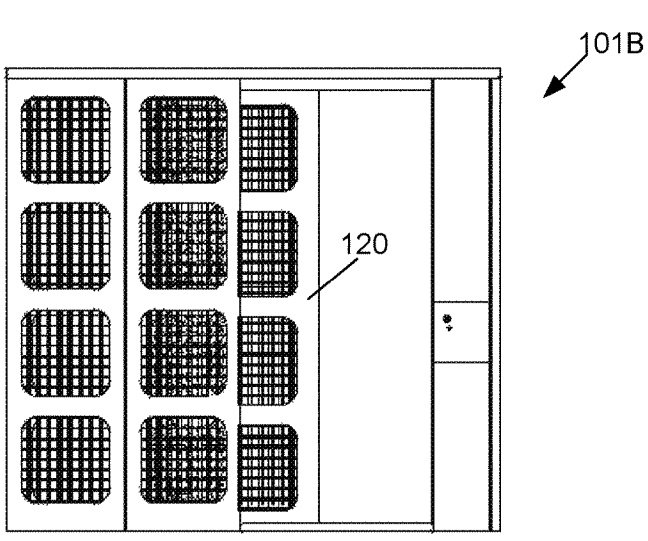
FIG. 17B is a front view of the security cage of FIG. 16 but with the door partially opened according to an exemplary embodiment.
Figure 17A:
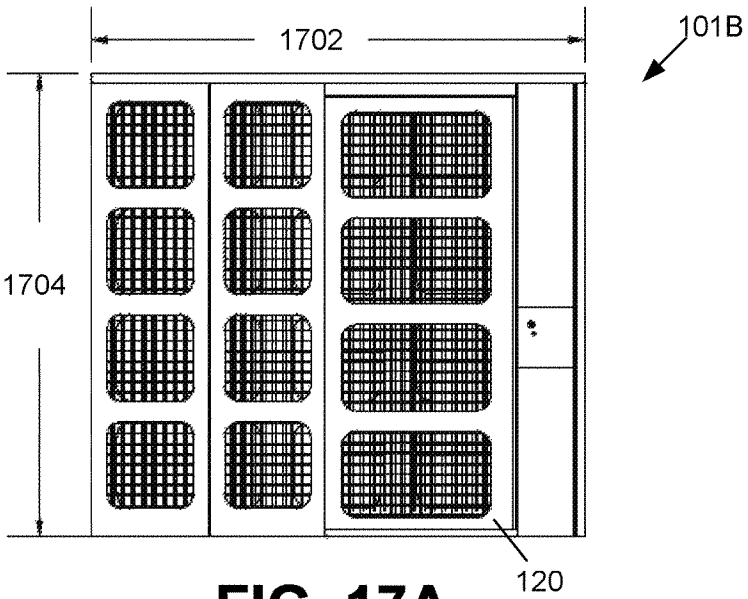
FIG. 17A is front view of the security cage of FIG. 16 according to an exemplary embodiment.

Referring now to FIG. 17A, this figure is front view of the security cage/system 101B of FIG. 16 according to an exemplary embodiment. This view shows that the cage 101B may have an exemplary height dimension 1704 and an exemplary width dimension 1702. Similar to the three walled cage system 101A of FIGS. 1-15, the cage/system 101B of FIG. 17A may have a width dimension 1702 for the cage/system 101B between about 1.0 feet and about 80.0 feet, and the height dimension 1704 may have a magnitude between about 1.0 feet to about 50.0 feet.

Referring now to FIG. 17B, this figure is a front view of the security cage/system 101B of FIG. 16 but with the door 120 partially opened according to an exemplary embodiment. Similar to the system/cage 101A of FIGS. 1-15, the door 120 of the cage/system 101B may comprise a sliding door that use casters. However, as noted above, other doors 120 which may use hinges or other types of fasteners for different movements are possible and are included within the scope of this disclosure as understood by one of ordinary skill in the art.

Figure 17C:
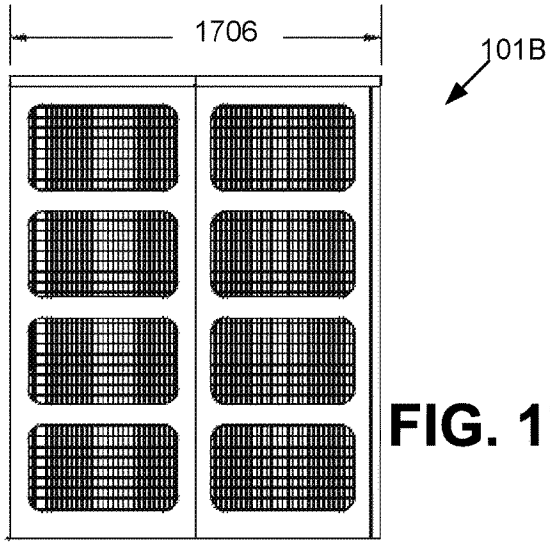
FIG. 17C is a side view of the security cage of FIG. 16 according to an exemplary embodiment.

Referring now to FIG. 17C, this figure is a side view of the security cage/system 101B of FIG. 16 according to an exemplary embodiment. The cage/system 101 may have an exemplary length dimension 1706 between about 1.0 feet and about 80.0 feet.

All elements of the cage/system 101 may be made from metal. However, as understood by one of ordinary skill in the art, all parts/elements may be constructed out of non-metal materials like plastics, but, such non-metal constructions may not be compliant with local building ordinances and/or codes.

For clarity, not all components are shown on drawings; i.e.—several fasteners are not present on drawings.

Certain steps in the processes or process flows enabled by the mechanical drawings in this specification naturally precede others for the invention to function as described.

However, the invention is not limited to the order of the steps described if such order or sequence does not alter the functionality of the invention. That is, it is recognized that some steps may performed before, after, or parallel (substantially simultaneously with) other steps without departing from the scope and spirit of the invention. In some instances, certain steps may be omitted or not performed without departing from the invention.

The materials for the parts illustrated in the several figures, such as the side wall panels 115 and roof sections 110 may be made of metal, such as steel. Other metals may be employed without departing from the scope of this disclosure. Other metals include, but are not limited to, aluminum, bronze, copper, tin, lead, and alloys/combinations thereof. Further, other materials besides metals are also possible and are included within the scope of this disclosure. Other materials besides metals include, but are not limited to, polymers (i.e. plastics), ceramics, composite materials, and any combination thereof.

Although a few embodiments have been described in detail above, those skilled in the art will readily appreciate that many modifications are possible in the embodiments without materially departing from this disclosure. Accordingly, such modifications are intended to be included within the scope of this disclosure as defined in the following claims.

For example, while several side wall panels 115 are illustrated for each cage 101A, 101B, it is possible additional and/or fewer side wall panels 115 may be employed. Further, mechanical equivalents of any of the illustrated structures could be substituted for many of the structures illustrated in the several views as understood by one of ordinary skill in the art. Such substitutions of mechanical equivalent structures are included within the scope of this disclosure.

Similarly, in the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, sixth paragraph for any limitations of any of the claims herein, except for those in which the claim expressly uses the words 'means for' together with an associated function.

Therefore, although selected aspects have been illustrated and described in detail, it will be understood that various substitutions and alterations may be made therein without departing from the spirit and scope of the present invention, as defined by the following claims.

What is claimed is:

1. A cage system comprising:

a first wall panel, the first wall panel comprising two open facing edges along two of its sides and having identical geometries; each open facing edge having a first gap and at least two edge portions;

a second wall panel, the second wall panel comprising two closed facing edges along two of its sides and having identical geometries; each closed facing edge having a second gap and at least two edge portions, the first wall panel and second wall panel mating together along one open facing edge and one closed facing edge such that the at least two edge portions of each edge come into direct contact with one another and such that the mating edge portions of the first and second wall panels define a completely closed rectangular shape, whereby fasteners between the two wall panels are substantially reduced or eliminated; and at least one ceiling panel that is coupled to one of the first and second wall panels, wherein the at least one ceiling panel is coupled to one of the first and second wall panels with a coupling device comprising a groove that has tabs which couple the at least one ceiling panel to one of the first and second wall panels.

2. The cage system of claim 1, wherein each open facing edge comprises at least four edge portions.

3. The cage system of claim 2, wherein the four edge portions of each open facing edge are disposed at approximately 90.0 degrees relative to each other.

4. The cage system of claim 1, wherein each closed facing edge comprises at least three edge portions.

5. The cage system of claim 4, wherein the edge portions of each closed facing edge are at approximately 90.0 degrees relative to each other.

6. The cage system of claim 1, further comprising a door.

7. A cage system comprising:

a first wall panel, the first wall panel comprising two open facing edges along two of its sides and having identical geometries; each open facing edge having a first gap and at least two edge portions, wherein the at least two edge portions form a rectilinear-shaped channel;

a second wall panel, the second wall panel comprising two closed facing edges along two of its sides and having identical geometries; each closed facing edge having a second gap and at least two edge portions, the first wall panel and second wall panel mating together along one open facing edge and one closed facing edge such that the at least two edge portions of each edge come into direct contact with one another and such that the mating edge portions of the first and second wall panels define a completely closed rectangular shape, and wherein at least one edge of one closed facing edge is positioned within the rectilinear channel, whereby fasteners between the two wall panels are substantially reduced or eliminated; and at least one ceiling panel that is coupled to the first and second wall panels, wherein the at least one ceiling panel is coupled to one of the first and second wall panels with a coupling device comprising a groove that has tabs which couple the at least one ceiling panel to one of the first and second wall panels.

8. The cage system of claim 7, wherein each open facing edge comprises at least four edge portions.

9. The cage system of claim 8, wherein the four edge portions of each open facing edge are disposed at approximately 90.0 degrees relative to each other.

10. The cage system of claim 7, wherein each closed facing edge comprises at least three edge portions.

11. The cage system of claim 10, wherein the edge portions of each closed facing edge are at approximately 90.0 degrees relative to each other.

12. The cage system of claim 7, further comprising a door.

13. The cage system of claim 7, wherein the first wall panel and the second wall panel are made from metal.

14. The cage system of claim 7, where the first wall panel comprises a wire-mesh section, and the second wall panel comprises a wire-mesh section.

* * * * *